US007559837B1

(12) United States Patent
Yoseloff et al.

(10) Patent No.: US 7,559,837 B1
(45) Date of Patent: Jul. 14, 2009

(54) VIDEO GAMING SYSTEM WITH WILD CARD SYSTEM AND BONUS SYSTEM

(75) Inventors: Mark L. Yoseloff, Henderson, NV (US); Russell B. Dunn, Henderson, NV (US); Josef Alexander Hartl, Henderson, NV (US)

(73) Assignee: IGT, Reno, NV (US)

( * ) Notice: Subject to any disclaimer, the term of this patent is extended or adjusted under 35 U.S.C. 154(b) by 235 days.

(21) Appl. No.: 09/654,025

(22) Filed: Sep. 1, 2000

(51) Int. Cl.
*A63F 9/24* (2006.01)

(52) U.S. Cl. ..... 463/21; 463/16; 463/20; 273/143 R

(58) Field of Classification Search ..... 463/16–21, 463/1; 273/143 R
See application file for complete search history.

(56) References Cited

U.S. PATENT DOCUMENTS

| | | | |
|---|---|---|---|
| 1,978,395 | A | 10/1934 | Groetchen |
| 2,545,644 | A | 3/1951 | Benton et al. |
| 3,420,525 | A | 1/1969 | Waders |
| 3,642,287 | A | 2/1972 | Lally et al. |
| 3,667,757 | A | 6/1972 | Holmberg |
| 3,735,987 | A | 5/1973 | Ohki |
| 4,198,052 | A | 4/1980 | Gauselmann |
| 4,258,838 | A | 3/1981 | Rockola et al. |
| 4,410,178 | A | 10/1983 | Partridge |
| 4,448,419 | A | 5/1984 | Telnaes |
| 4,513,970 | A | 4/1985 | Opresco et al. |
| 4,560,161 | A | 12/1985 | Hamano |
| 4,582,324 | A | 4/1986 | Koza et al. |
| 4,586,713 | A | 5/1986 | Abu-Shumays et al. |
| 4,618,150 | A | 10/1986 | Kimura |
| 4,624,459 | A | 11/1986 | Kaufman |
| 4,648,600 | A | 3/1987 | Olliges |
| 4,695,053 | A | 9/1987 | Vazquez, Jr. et al. |
| 4,706,956 | A | 11/1987 | Abu-Shumays et al. |
| 4,722,527 | A | 2/1988 | Gauselmann |
| 4,743,022 | A | 5/1988 | Wood |
| 4,756,531 | A | 7/1988 | DiRe et al. |
| 4,805,907 | A | 2/1989 | Haiwara |

(Continued)

FOREIGN PATENT DOCUMENTS

AU 1997 16432 B2 9/1997

(Continued)

OTHER PUBLICATIONS

Black Swan Paytable Display written by IGT, published prior to December of 2001.

(Continued)

*Primary Examiner*—Dmitry Suhol
*Assistant Examiner*—Robert Mosser
(74) *Attorney, Agent, or Firm*—K&L Gates, LLP

(57) ABSTRACT

A gaming system for producing a unique bonusing event is described. The method includes the step of a player placing a wager on a reel-slot-type video game and displaying a plurality of randomly selected game symbols on the game display. Upon the occurrence of a triggering event, such as a winning or losing combination of symbols, randomly selecting a number of wild symbol positions, and location of the wild symbol positions on the screen display. The wild symbol positions are then converted to wild symbols, and the game is scored using the original game symbols and wild symbols.

43 Claims, 3 Drawing Sheets

U.S. PATENT DOCUMENTS

| | | | |
|---|---|---|---|
| 4,817,952 | A | 4/1989 | Biro et al. |
| 4,836,546 | A | 6/1989 | DiRe et al. |
| 4,836,553 | A | 6/1989 | Suttle et al. |
| 4,838,552 | A | 6/1989 | Hagiwara |
| 4,844,467 | A | 7/1989 | Gyenge et al. |
| 4,861,041 | A | 8/1989 | Jones et al. |
| 4,871,171 | A | 10/1989 | Rivero |
| 4,874,173 | A | 10/1989 | Kishishita |
| 4,889,340 | A | 12/1989 | Greene |
| 4,991,848 | A | 2/1991 | Greenwood et al. |
| 5,019,973 | A | 5/1991 | Wilcox et al. |
| 5,033,744 | A | 7/1991 | Bridgeman et al. |
| 5,042,818 | A | 8/1991 | Weingardt |
| 5,067,712 | A | 11/1991 | Georgilas |
| 5,078,405 | A | 1/1992 | Jones et al. |
| 5,085,435 | A | 2/1992 | Rossides |
| 5,085,436 | A | 2/1992 | Bennett |
| 5,092,598 | A | 3/1992 | Kamille |
| 5,098,107 | A | 3/1992 | Boylan et al. |
| 5,102,134 | A | 4/1992 | Smyth |
| 5,102,137 | A | 4/1992 | Ekiert |
| 5,152,529 | A | 10/1992 | Okada |
| 5,154,429 | A | 10/1992 | LeVasseur |
| 5,167,413 | A | 12/1992 | Fulton |
| 5,178,390 | A | 1/1993 | Okada |
| 5,205,555 | A | 4/1993 | Hamano |
| 5,209,479 | A | 5/1993 | Nagao et al. |
| 5,211,399 | A | 5/1993 | Howard |
| 5,224,706 | A | 7/1993 | Bridgeman et al. |
| 5,249,800 | A | 10/1993 | Hilgendorf et al. |
| 5,257,784 | A | 11/1993 | Boylan et al. |
| 5,259,616 | A | 11/1993 | Bergmann |
| 5,282,633 | A | 2/1994 | Boylan et al. |
| 5,288,077 | A | 2/1994 | Jones |
| 5,288,081 | A | 2/1994 | Breeding |
| 5,308,065 | A | 5/1994 | Bridgeman et al. |
| 5,332,219 | A | 7/1994 | Marnell, II et al. |
| 5,332,228 | A | 7/1994 | Schultz |
| 5,342,047 | A | 8/1994 | Heidel et al. |
| 5,342,049 | A | 8/1994 | Wichinsky et al. |
| 5,362,052 | A | 11/1994 | Kubatsch |
| 5,364,100 | A | 11/1994 | Ludlow et al. |
| 5,364,105 | A | 11/1994 | Jones |
| 5,373,440 | A | 12/1994 | Cohen et al. |
| 5,377,973 | A | 1/1995 | Jones et al. |
| 5,393,057 | A | 2/1995 | Marnell, II |
| 5,393,061 | A | 2/1995 | Manship et al. |
| 5,395,111 | A | 3/1995 | Inoue |
| 5,407,200 | A | 4/1995 | Zalabak |
| 5,423,539 | A | 6/1995 | Nagao |
| 5,429,507 | A | 7/1995 | Kaplan |
| 5,431,407 | A | 7/1995 | Hofberg et al. |
| 5,431,408 | A | 7/1995 | Adams |
| 5,437,462 | A | 8/1995 | Breeding |
| 5,449,173 | A | 9/1995 | Thomas et al. |
| 5,452,899 | A | 9/1995 | Skratulia et al. |
| 5,456,465 | A | 10/1995 | Durham |
| 5,489,101 | A | 2/1996 | Moody |
| 5,490,670 | A | 2/1996 | Hobert |
| 5,494,287 | A | 2/1996 | Manz |
| 5,511,781 | A | 4/1996 | Wood et al. |
| 5,524,888 | A | 6/1996 | Heidel |
| 5,529,309 | A | 6/1996 | Bartlett |
| 5,531,440 | A | 7/1996 | Dabrowski et al. |
| 5,531,441 | A | 7/1996 | Dabrowski et al. |
| 5,536,016 | A | 7/1996 | Thompson |
| 5,542,669 | A | 8/1996 | Charron et al. |
| 5,560,603 | A | 10/1996 | Seelig et al. |
| 5,569,084 | A | 10/1996 | Nicastro et al. |
| 5,577,731 | A | 11/1996 | Jones |
| 5,580,311 | A | 12/1996 | Haste, III |
| 5,584,485 | A | 12/1996 | Jones et al. |
| 5,584,764 | A | 12/1996 | Inoue |
| 5,607,162 | A | 3/1997 | Boylan et al. |
| 5,611,535 | A | 3/1997 | Tiberio |
| 5,620,182 | A | 4/1997 | Rossides |
| 5,626,341 | A | 5/1997 | Jones et al. |
| 5,642,882 | A | 7/1997 | Guerzini |
| 5,642,884 | A | 7/1997 | Pitcher |
| 5,647,798 | A | 7/1997 | Falciglia |
| 5,655,965 | A | 8/1997 | Takemoto et al. |
| 5,660,391 | A | 8/1997 | Klasee |
| 5,660,393 | A | 8/1997 | Dreger |
| 5,664,781 | A | 9/1997 | Feola |
| 5,711,525 | A | 1/1998 | Breeding |
| 5,720,662 | A | 2/1998 | Holmes, Jr. et al. |
| D392,340 | S | 3/1998 | DeSimone |
| 5,722,891 | A | 3/1998 | Inoue |
| 5,732,948 | A | 3/1998 | Yoseloff |
| 5,743,524 | A | 4/1998 | Nannicola |
| 5,749,784 | A | 5/1998 | Clapper, Jr. |
| 5,752,881 | A | 5/1998 | Inoue |
| 5,762,552 | A | 6/1998 | Vuong et al. |
| 5,766,074 | A | 6/1998 | Cannon et al. |
| 5,769,716 | A | 6/1998 | Saffari et al. |
| 5,772,506 | A | 6/1998 | Marks et al. |
| 5,772,509 | A | 6/1998 | Weiss |
| 5,775,692 | A | 7/1998 | Watts et al. |
| 5,788,573 | A | 8/1998 | Baerlocher et al. |
| 5,794,964 | A | 8/1998 | Jones et al. |
| 5,795,225 | A | 8/1998 | Jones et al. |
| 5,807,172 | A | 9/1998 | Piechowiak |
| 5,810,361 | A | 9/1998 | Kadlic |
| 5,816,915 | A | 10/1998 | Kadlic |
| 5,816,918 | A | 10/1998 | Kelly et al. |
| 5,823,534 | A | 10/1998 | Banyai |
| 5,823,873 | A | 10/1998 | Moody |
| 5,823,874 | A | 10/1998 | Adams |
| 5,833,536 | A | 11/1998 | Davids et al. |
| 5,833,537 | A | 11/1998 | Barrie |
| 5,848,932 | A | 12/1998 | Adams |
| 5,851,148 | A | 12/1998 | Brune et al. |
| 5,855,514 | A | 1/1999 | Kamille |
| 5,863,041 | A | 1/1999 | Boylan et al. |
| 5,868,618 | A | 2/1999 | Netley et al. |
| 5,868,619 | A | 2/1999 | Wood et al. |
| 5,873,781 | A | 2/1999 | Keane |
| 5,882,259 | A | 3/1999 | Holmes, Jr. et al. |
| 5,882,261 | A | 3/1999 | Adams |
| 5,885,157 | A | 3/1999 | Harada et al. |
| 5,890,962 | A | 4/1999 | Takemoto |
| 5,911,418 | A | 6/1999 | Adams |
| 5,918,880 | A | 7/1999 | Voigt, IV et al. |
| 5,919,088 | A | 7/1999 | Weiss |
| 5,927,714 | A | 7/1999 | Kaplan |
| 5,934,672 | A * | 8/1999 | Sines et al. ..... 273/143 R |
| 5,935,002 | A | 8/1999 | Falciglia |
| 5,944,315 | A | 8/1999 | Mostashari |
| 5,947,820 | A | 9/1999 | Morro et al. |
| 5,947,821 | A | 9/1999 | Stone |
| 5,951,397 | A | 9/1999 | Dickinson |
| 5,964,463 | A | 10/1999 | Moore, Jr. |
| 5,967,894 | A | 10/1999 | Kinoshita et al. |
| 5,971,849 | A | 10/1999 | Falciglia |
| 5,980,384 | A | 11/1999 | Barrie |
| 5,984,781 | A | 11/1999 | Sunaga |
| 5,988,638 | A | 11/1999 | Rodesch et al. |
| 5,996,997 | A | 12/1999 | Kamille |
| 5,997,400 | A | 12/1999 | Seelig et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,066 | A | 12/1999 | Moody |
| 6,012,982 | A | 1/2000 | Piechowiak et al. |

6,015,344 A 1/2000 Kelly et al.
6,015,346 A 1/2000 Bennett
6,019,369 A 2/2000 Nakagawa et al.
6,033,307 A 3/2000 Vancura
6,056,289 A 5/2000 Clapper, Jr.
6,056,642 A 5/2000 Bennett
6,059,289 A 5/2000 Vancura
6,059,658 A 5/2000 Mangano et al.
6,062,978 A 5/2000 Martino et al.
6,062,980 A 5/2000 Luciano
6,068,552 A 5/2000 Walker et al.
6,086,066 A 7/2000 Takeuchi et al.
6,089,976 A 7/2000 Schneider et al.
6,089,977 A * 7/2000 Bennett ..... 463/20
6,089,978 A 7/2000 Adams
6,093,102 A 7/2000 Bennett
6,095,921 A 8/2000 Walker et al.
6,102,400 A 8/2000 Scott et al.
6,102,798 A 8/2000 Bennett
6,117,009 A 9/2000 Yoseloff
6,120,031 A 9/2000 Adams
6,120,377 A 9/2000 McGinnis, Sr. et al.
6,120,378 A 9/2000 Moody
6,126,541 A 10/2000 Fuchs
6,126,542 A 10/2000 Fier
6,135,885 A 10/2000 Lermusiaux
6,142,872 A 11/2000 Walker et al.
6,142,873 A 11/2000 Weiss et al.
6,142,874 A 11/2000 Kodachi et al.
6,142,875 A 11/2000 Kodachi et al.
6,146,273 A 11/2000 Olsen
6,149,156 A 11/2000 Feola
6,149,521 A 11/2000 Sanduski
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,165,070 A 12/2000 Nolte et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,894 B1 2/2001 Mayeroff
6,190,254 B1 2/2001 Bennett
6,190,255 B1 2/2001 Thomas et al.
6,200,217 B1 3/2001 Osawa
6,203,409 B1 3/2001 Kennedy et al.
6,203,428 B1 3/2001 Giobbi et al.
6,203,429 B1 3/2001 Demar et al.
6,210,279 B1 4/2001 Dickinson
6,213,875 B1 4/2001 Suzuki
6,213,876 B1 4/2001 Moore, Jr.
6,220,959 B1 4/2001 Holmes, Jr. et al.
6,224,483 B1 5/2001 Mayeroff
6,224,484 B1 5/2001 Okuda et al.
6,227,970 B1 5/2001 Shimizu et al.
6,231,442 B1 5/2001 Mayeroff
6,231,445 B1 5/2001 Acres
6,234,897 B1 * 5/2001 Frohm et al. ..... 463/20
6,238,287 B1 5/2001 Komori et al.
6,238,288 B1 5/2001 Walker et al.
6,241,607 B1 6/2001 Payne et al.
6,251,013 B1 * 6/2001 Bennett ..... 463/13
D445,841 S 7/2001 Sabo
6,261,177 B1 7/2001 Bennett
6,270,408 B1 8/2001 Sakamoto
6,270,409 B1 8/2001 Shuster
6,270,411 B1 8/2001 Gura et al.
6,270,412 B1 8/2001 Crawford et al.
6,287,194 B1 9/2001 Okada et al.
6,290,600 B1 * 9/2001 Glasson ..... 463/20
6,295,790 B1 10/2001 Tracy
6,296,568 B1 10/2001 Tracy
6,299,165 B1 10/2001 Nagano
6,299,170 B1 10/2001 Yoseloff
6,302,398 B1 10/2001 Vecchio
6,305,686 B1 10/2001 Perrie et al.
6,309,300 B1 10/2001 Glavich
6,311,976 B1 11/2001 Yoseloff et al.
6,312,334 B1 11/2001 Yoseloff
6,315,660 B1 * 11/2001 DeMar et al. ..... 463/16
6,315,663 B1 11/2001 Sakamoto
6,315,664 B1 11/2001 Baerlocher
6,319,124 B1 11/2001 Baerlocher et al.
6,322,078 B1 11/2001 Adams
6,322,309 B1 11/2001 Thomas et al.
6,328,649 B1 12/2001 Randall et al.
6,334,814 B1 1/2002 Adams
6,336,860 B1 * 1/2002 Webb ..... 463/22
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,358,144 B1 3/2002 Kaddlic et al.
6,358,147 B1 3/2002 Jaffe et al.
6,364,766 B1 4/2002 Anderson et al.
6,364,768 B1 4/2002 Acres et al.
6,375,187 B1 4/2002 Baerlocher
6,375,570 B1 4/2002 Poole
6,394,902 B1 5/2002 Glavich et al.
D458,311 S 6/2002 Seelig et al.
6,398,218 B1 6/2002 Vancura
6,398,220 B1 6/2002 Inoue
6,398,644 B1 6/2002 Perrie et al.
6,406,369 B1 6/2002 Baerlocher et al.
6,413,160 B1 7/2002 Vancura
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,425,824 B1 7/2002 Baerlocher et al.
6,428,412 B1 8/2002 Anderson et al.
6,431,548 B1 8/2002 Voigt, IV et al.
6,435,511 B1 8/2002 Vancura et al.
6,439,943 B1 8/2002 Aoki et al.
6,439,993 B1 * 8/2002 O'Halloran ..... 463/16
6,439,995 B1 8/2002 Hughs-Baird et al.
D463,504 S 9/2002 Stephan
6,443,452 B1 9/2002 Brune
6,443,837 B1 9/2002 Jaffe et al.
6,454,266 B1 9/2002 Breeding et al.
6,454,651 B1 9/2002 Yoseloff
6,461,241 B1 10/2002 Webb et al.
6,464,582 B1 10/2002 Baerlocher et al.
6,468,156 B1 10/2002 Hughs-Baird et al.
6,471,208 B2 10/2002 Yoseloff et al.
6,481,713 B2 11/2002 Perrie et al.
6,491,584 B2 12/2002 Graham et al.
6,494,454 B2 12/2002 Adams
6,494,785 B1 12/2002 Gerrard et al.
6,506,114 B1 1/2003 Estes et al.
6,506,118 B1 1/2003 Baerlocher et al.
6,511,375 B1 1/2003 Kaminkow
6,514,141 B1 2/2003 Kaminkow et al.
6,517,432 B1 2/2003 Jaffe
6,517,433 B2 2/2003 Loose et al.
6,537,150 B1 3/2003 Luciano et al.
6,537,152 B2 3/2003 Seelig et al.
6,551,187 B1 4/2003 Jaffe
6,554,703 B1 4/2003 Bussick et al.
6,554,704 B2 4/2003 Nicastro et al.
6,558,253 B1 5/2003 DeSimone et al.

6,558,254 B2 5/2003 Baerlocher et al.
6,561,904 B2 5/2003 Lock et al.
6,565,433 B1 5/2003 Baerlocher et al.
6,565,436 B1 5/2003 Baerlocher
6,569,015 B1 5/2003 Baerlocher et al.
6,569,016 B1 5/2003 Baerlocher
6,572,471 B1 6/2003 Bennett
6,572,473 B1 6/2003 Baerlocher
6,575,830 B2 6/2003 Baerlocher et al.
6,585,591 B1 7/2003 Baerlocher et al.
6,589,114 B2 7/2003 Rose
6,592,457 B1 7/2003 Frohm et al.
6,595,854 B2 7/2003 Hughs-Baird et al.
6,599,185 B1 7/2003 Kaminkow et al.
6,599,192 B1 7/2003 Baerlocher et al.
6,602,137 B2 8/2003 Kaminkow et al.
6,604,740 B1 8/2003 Singer et al.
6,605,002 B2 8/2003 Baerlocher
6,607,437 B2 8/2003 Casey et al.
6,607,438 B2 8/2003 Baerlocher et al.
6,609,974 B2 8/2003 Mead et al.
6,616,142 B2 9/2003 Adams
6,632,139 B1 10/2003 Baerlocher
6,632,140 B2 10/2003 Berman et al.
6,632,141 B2 10/2003 Webb et al.
6,634,941 B2 10/2003 Olive
6,634,943 B1 10/2003 Baerlocher
6,634,945 B2 10/2003 Glavich et al.
6,638,164 B2 10/2003 Randall et al.
6,644,663 B2 11/2003 Seelig et al.
6,644,664 B2 11/2003 Muir et al.
6,659,864 B2 12/2003 McGahn et al.
6,676,512 B2 1/2004 Fong et al.
6,712,694 B1 3/2004 Nordman
6,719,630 B1 4/2004 Seelig et al.
6,726,204 B2 4/2004 Inoue
6,729,621 B2 5/2004 Moody
6,733,389 B2 5/2004 Webb et al.
6,746,329 B1 6/2004 Duhamel
6,761,632 B2 7/2004 Bansemer et al.
6,780,109 B2 8/2004 Kaminkow
6,786,818 B1 9/2004 Rothschild et al.
6,796,903 B1 9/2004 Bryant
6,805,349 B2 10/2004 Baerlocher et al.
6,805,632 B2 10/2004 Suda
6,808,454 B2 10/2004 Gerrard et al.
6,855,056 B2 2/2005 Inoue
6,866,583 B2 3/2005 Glavich et al.
6,869,360 B2 3/2005 Marks et al.
D504,473 S 4/2005 Baerlocher
6,880,826 B2 4/2005 Inoue
6,893,018 B2 5/2005 Inoue
6,905,406 B2 6/2005 Kaminkow et al.
6,913,532 B2 7/2005 Baerlocher et al.
6,921,335 B2 7/2005 Rodgers et al.
6,932,700 B2 8/2005 Bennett et al.
6,955,600 B2 10/2005 Glavich et al.
6,960,133 B1 11/2005 Marks et al.
7,001,274 B2 2/2006 Baerlocher et al.
7,014,560 B2 3/2006 Glavich et al.
7,056,213 B2 6/2006 Ching et al.
7,074,127 B2 7/2006 Cuddy et al.
7,090,580 B2 8/2006 Rodgers et al.
7,094,148 B2 8/2006 Baerlocher et al.
2001/0009865 A1 7/2001 Demar et al.
2001/0019965 A1 9/2001 Ochi
2002/0010017 A1 1/2002 Bennett
2002/0025844 A1 2/2002 Casey et al.
2002/0045475 A1 4/2002 Glavich et al.
2002/0072402 A1 6/2002 Baerlocher
2002/0094857 A1 7/2002 Meyer
2002/0142822 A1 10/2002 Baerlocher et al.
2002/0151350 A1 10/2002 Baerlocher et al.
2002/0155883 A1 10/2002 Baerlocher
2002/0193160 A1 12/2002 Tarantino
2003/0013514 A1 1/2003 Cregan et al.
2003/0040355 A1 2/2003 Baerlocher
2003/0045344 A1 3/2003 Webb et al.
2003/0045348 A1 3/2003 Palmer et al.
2003/0045354 A1 3/2003 Giobbi
2003/0054875 A1 3/2003 Marks et al.
2003/0060267 A1 3/2003 Glavich et al.
2003/0060272 A1 3/2003 Glavich et al.
2003/0064768 A1 4/2003 Fier
2003/0064795 A1 4/2003 Baerlocher et al.
2003/0064802 A1 4/2003 Rodgers
2003/0069062 A1 4/2003 Shimizu
2003/0073483 A1 4/2003 Glavich et al.
2003/0162585 A1 8/2003 Bigelow et al.
2003/0203752 A1 10/2003 Kaminkow et al.
2003/0203753 A1 10/2003 Muir et al.
2003/0216165 A1 11/2003 Singer et al.
2004/0002372 A1 1/2004 Rodgers et al.
2004/0009803 A1 1/2004 Bennett et al.
2004/0012145 A1 1/2004 Inoue
2004/0014516 A1 1/2004 Inoue
2004/0014517 A1 1/2004 Inoue
2004/0018866 A1 1/2004 Inoue
2004/0026854 A1 2/2004 Inoue
2004/0036218 A1 2/2004 Inoue
2004/0038726 A1 2/2004 Inoue
2004/0038731 A1 2/2004 Englman
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0053676 A1 3/2004 Rodgers
2004/0072612 A1 4/2004 Rodgers et al.
2004/0137982 A1 7/2004 Cuddy et al.
2004/0147306 A1 7/2004 Randall et al.
2004/0155399 A1 8/2004 Inoue
2004/0183251 A1 9/2004 Inoue
2004/0192431 A1 9/2004 Singer et al.
2004/0195773 A1 10/2004 Masci et al.
2004/0242313 A1 12/2004 Munoz
2004/0266516 A1 12/2004 Thomas
2004/0266517 A1 12/2004 Bleich et al.
2005/0020344 A1 1/2005 Kaminkow
2005/0043083 A1 2/2005 Inoue
2005/0043084 A1 2/2005 Inoue
2005/0049035 A1 3/2005 Baerlocher et al.
2005/0059478 A1 3/2005 Peterson et al.
2005/0064924 A1 3/2005 Glavich
2005/0070354 A1 3/2005 Baerlocher et al.
2005/0075163 A1 4/2005 Cuddy et al.
2005/0104298 A1 5/2005 Butcher et al.
2005/0233801 A1 10/2005 Baerlocher et al.
2005/0266917 A1 12/2005 Glavich et al.
2005/0277460 A1 12/2005 Inoue
2006/0040728 A1 2/2006 Fuller
2006/0046830 A1 3/2006 Webb
2006/0068884 A1 3/2006 Baerlocher et al.
2006/0073876 A1 4/2006 Cuddy

FOREIGN PATENT DOCUMENTS

AU 199717601 B2 9/1997
AU 1996 50327 10/1997
AU A-50327/96 10/1997
AU 199747657 B2 12/1997
AU B-43613/97 2/1998
AU 722 969 6/1998
AU 199917318 A1 9/1999
AU 778685 4/2005
DE 31 05 266 9/1982

| | | | |
|---|---|---|---|
| DE | 3700861 | | 7/1988 |
| DE | 4014477 | | 7/1991 |
| EP | 0 060 019 | A1 | 9/1982 |
| EP | 0410789 | | 2/1990 |
| EP | 0737494 | | 12/1994 |
| EP | 0 688 022 | | 12/1995 |
| EP | 0 798 676 | | 10/1997 |
| EP | 0 874 337 | | 10/1998 |
| EP | 0 926 645 | | 6/1999 |
| EP | 0 944 030 | | 9/1999 |
| EP | 0 981 119 | | 2/2000 |
| EP | 0 984 408 | A2 | 3/2000 |
| EP | 1039424 | | 3/2000 |
| EP | 1063622 | | 5/2000 |
| EP | 0 984 409 | | 8/2000 |
| EP | 1 184 822 | | 3/2002 |
| EP | 1 296 296 | A2 | 3/2003 |
| EP | 1 513 117 | | 3/2005 |
| GB | 1 464 896 | | 2/1977 |
| GB | 2 066 991 | | 7/1981 |
| GB | 2 072 395 | | 9/1981 |
| GB | 2 083 936 | | 3/1982 |
| GB | 2 084 371 | | 4/1982 |
| GB | 2 092 797 | | 8/1982 |
| GB | 2 096 376 | | 10/1982 |
| GB | 2 097 160 | | 10/1982 |
| GB | 2101380 | A | 1/1983 |
| GB | 2 106 292 | | 4/1983 |
| GB | 2 117 155 | | 10/1983 |
| GB | 2 144 644 | | 3/1985 |
| GB | 2 170 636 | | 8/1986 |
| GB | 2 180 087 | | 3/1987 |
| GB | 2 181 589 | | 4/1987 |
| GB | 2 183 882 | | 6/1987 |
| GB | 2193827 | A | 2/1988 |
| GB | 2 201 821 | | 9/1988 |
| GB | 2 202 984 | | 10/1988 |
| GB | 2 222 712 | | 3/1990 |
| GB | 2 226 436 | | 6/1990 |
| GB | 2 253 300 | | 2/1992 |
| GB | 2 322 217 | | 8/1998 |
| GB | 2 328 311 | | 2/1999 |
| GB | 2 353 128 | | 2/2001 |
| WO | WO 93/03464 | | 2/1993 |
| WO | WO 97/32285 | | 9/1997 |
| WO | WO 99/10849 | | 3/1999 |
| WO | WO 00/12186 | | 3/2000 |
| WO | WO 00/32286 | | 6/2000 |
| WO | WO 00/59591 | | 10/2000 |
| WO | WO 00/66235 | | 11/2000 |
| WO | WO 00/76606 | A1 | 12/2000 |
| WO | WO 01/26019 | | 4/2001 |
| WO | WO 2004025584 | | 3/2004 |

OTHER PUBLICATIONS

Boot Scootin Article written by Strictly Slots/Aristocrat Leisure Industries, PTY Ltd., published in April of 2001.
Break the Spell Advertisement written by Atronic Casino Technology, Ltd., published in 1999, on or before December thereof.
Break the Spell Article written by Strictly Slots/Atronic Casino Technology, Ltd., published in September of 2000.
Break the Spell Atronic Web Page, published in January of 2001.
Break the Spell Brochure, Article and Website page, Atronic Americas, LLC, Strictly Slots, published in 1999, 2000, printed on Jan. 15, 2001.
Break the Spell Brochure, published in 1999, on or before December thereof.
Cash Chameleon Article written by Strictly Slots/Aristocrat Leisure Industries, PTY Ltd., published in April of 2001.
Cossack Dance Advertisement written by Olympic Video Gaming, published prior to January of 2003.
Description of Symbol Feature in Australian UFO Gaming Machine written by Barcrest Ltd., published in 1995, on or before December thereof.
Double Diamond Line Advertisement written by Bally Gaming Systems, published in 2000, on or before December thereof.
Enchanted Forest Brochure, Aristocrat, Incorporated, published in 1995, on or before December thereof.
Enchanted Forest™ Gaming Description from Aristocrat, available in 1994, on or before December thereof.
Enchanted Unicorn Advertisement written by IGT, published in 2001, on or before December thereof.
Field Testing New Slots Article, written by Strictly Slots, published in July of 2000.
Fishin' Buddies Article published in Strictly Slots/Anchor Games, published in April of 2001.
Happy Camper Advertisement written by IGT, published in 2001, on or before December thereof.
Introducing the "Smiling Ape" Machine Advertisement (including Joker's Wild Poker description) written by IGT, published prior to January of 2002.
Jackpot Party Brochure and Articles written by WMS Gaming, Inc., published in 1988, on or before December thereof.
Joker's Wild Advertisement written by IGT, published prior to January of 2002.
Little Green Men, Jr. Advertisement written by A.C. Coin and Slot Services Company, published prior to January of 2003.
Loco Loot Article written by Strictly Slots/Aristocrat Leisure Industries, PTY Ltd., published in May of 2002.
Mountain Money Article written by Strictly Slots/Aristocrat Leisure Industries, PTY Ltd., published in June of 2002.
Munsters Article and Website page, Strictly Slots, IGT, undated, printed on Mar. 21, 2001.
Penguin Pays Advertisement written by Aristocrat Incorporated, published in 1998, on or before December thereof.
Reel Magic™ Gaming Machine Description written by IGT, available in 1986, on or before December thereof.
The Basics of Winning Video Poker (Chapter VI Deuces Wild & Chapter VII Jokers Wild) written by J. Edward Allen, published in 1990, on or before December thereof.
The Latest Buzz Article, written by Bally Gaming Systems, published in 2000, on or before December thereof.
Wild Streak Advertisement written by WMS Gaming, Inc., published in 2001, on or before December thereof.
Your Real Key to Gaming Success Advertisement (including Roll Over Beethoven and Wild Fortune) written by Olympic Video Gaming, published prior to Jul. 31, 2003.
3-Way Action Poker Brochure and Article written by IGT, published in 2002, in or before December thereof.
Addams Family Advertisement and Article written by IGT, published in Strictly Slots in 2000, in or before December thereof.
Agassi Article written by Aristocrat Leisure Industries, published by Strictly Slots in Aug. 2005.
American Thunder Screen Shots written by IGT, published in 1998, in or before December thereof.
Bally Slot Machines Electro-Mechanicals 1964-1980 Book, Revised 3rd Edition [in part] written by Marshall Fey.
Bally Live! Special Global Gaming Expo 2002 issue, written by Bally Gaming Systems, published in 2002, in or before December thereof.
Barn Yard Article, published in Strictly Slots, published in Mar. 2002.
Barn Yard Advertisement, written by Aristocrat, available prior to November 2006.
Big Bang Piggy Bankin Advertisement written by WMS Gaming, Inc., published prior to 2000, in or before December thereof.
Bonus Times written by Bally Gaming, published in 2000, in or before December thereof.
Bunco Night Advertisement written by IGT, published in 2000, in or before December thereof.
By George Advertisement, written by IGT, published in 2002, in or before December thereof.
Cash Box Advertisement and Article written by Anchor Games, published by Strictly Slots in 2000, in or before December thereof.

Cash Crop Brochure written by Arist O Crat Leisure Industries, published in 1997, in or before December thereof.
Catch a Wave Advertisement written by IGT, published in Dec. 2000.
Chutes & Ladders Game Instructions, written by Hasbro-Milton Bradley, published in 1999, in or before December thereof.
Cleopatra Slots Advertisement, written by IGT, published in Game News in 2003, in or before December thereof.
Cleopatra Slots Vision Series Advertisement, written by IGT, published in 2003, in or before December thereof.
Cuckoo Aristocrat Brochure written by Aristocrat, published in Feb. 1998.
Dating Game IGT Slot Line Brochure, written by IGT, published in 2003, in or before December thereof.
Dating Game Article, written by IGT, published by Strictly Slots Aug. 2004.
Days Off Article, written by Konami, published in Strictly Slots in Feb. 2005.
Deep Blue Dollars Article, written by Atronic Casino Technology, Ltd., published in Jun. 2004.
Dice Games Article describing Poker Dice, published prior to 2001, in or before December thereof.
Dolphin Treasure Advertisement, written by Aristocrat Leisure Industries Pty., Ltd., published in 1996, in or before December thereof.
Double Bucks Brochure written by IGT, available prior to Jan. 2006.
Double Diamond Pennies Advertisement written by IGT, published in 2004, in or before December thereof.
Dream Maker Advertisement, written by Atronic Casino Technology, Ltd., published in 2002, in or before December thereof.
Faster Harder More Challenging Q*bert game description [online] [printed on Mar. 12, 2002]. Retrieved from the Internet at <URL:http://www.klov.com/F/
Faster__Harder__More__Challenging__Q*bert.html>.
Fire and Fortune written by Anchor Games, published in Strictly Slots, May 2001.
Fox 'N' Hound written by IGT, published in 2000, in or before December thereof.
Free! 7-Day Trial on Daval's Reel Dice Advertisement written by Gerber & glass, published in 1936, in or before December thereof.
Fundamentals of Craps book [In Part], written by Mason Malmuth and Lynne Loomis, published in 1995, in or before December thereof.
Good Times Brochure, written by IGT, published in 1999, in or before December thereof.
Gotlieb Emulator Project, written by Lee Taylor, [online] [printed on Mar. 12, 2002]. Retrieved from the Internet at <URL:http://www.defender.demon.co.uk/qbert.html>.
Happy Camper Advertisement written by IGT, published in 2001, on or before December thereof.
Happy Happy Hippy Advertisement written by Atronic Casino Technology, Ltd., published in 2000, in or before December thereof.
Hot Flashes Advertisement, written by IGT, published in 2005, in or before December thereof.
How to Play Q*bert, written by Gottlieb Amusement Games, [online] [printed on Mar. 12, 2002]. Retrieved from the Internet at <URL:http://users.rcn.com/e-glide/howto1.jpg> and <URL:http://users.rcn.com/e-glide/howto2.jpg>.
I Love Lucy Advertisement, written by IGT, published in 2002, in or before December thereof.
In Between Game Description, written by IGT, available prior to 2000, in or before December thereof.
Leopard Spots™ [online] [printed on Mar. 21, 2001]. Retrieved from the Internet at <URL:http://www.igt.com>.
Levy Patent Abstract written by Derwent Publications Ltd., published in 1991 in or before December thereof.
Loaded Dice written by Konami, published by Strictly Slots in December 2000.
Mayan Wheen of Gold Article, published by Strictly Slots prior to Sep. 30, 2004.
Mega Multiplier®, [online] [printed on May 22, 2001]. Retrieved from the Internet at <URL:http://www.wmsgaming.com>.
Mikohn Solutions Article in the World Gaming Congress 2000 Edition, in or before December thereof.
Money Grab, [online] [printed on May 22, 2001]. Retrieved from the Internet at <URL:http://www.wmsgaming.com>.
Money Mouse Brochure written by Arist O Crat Leisure Industries, published in 1997, in or before December thereof.
Monopoly Brochures and Articles, written by WMS Gaming, Inc., published in 1998, in or before December thereof.
Monopoly Party Train Article, published in Strictly Slots Feb. 2002.
The Munsters International Game Technology Advertisement, published in Strictly Slots, Apr. 2001.
Neon Nights written by IGT, published in 2000, in or before December thereof.
New Kids Article, published by Strictly Slots in Dec. 2000.
On The House Advertisement, written by Olympic Video Gaming, published prior to 2002, in or before December thereof.
On the Money Article written by Casino Data Systems, published by Strictly Slots in Dec. 2000.
Pick'em Poker Plus Advertisement written by Bally Gaming in 2002, in or before December thereof.
Polly & Roger Brochure written by VLS, Inc., published in 2000, in or before December thereof.
Price is Right "Cliff Hangers" description [online] [printed on Mar. 21, 2001]. Retrieved from the Internet at <URL:http://www.geocities.com; members.aol.com>.
Price is Right "Showcases" description [online] [printed on Mar. 16, 2001]. Retrieved from the Internet at <URL:http://www.schuminweb.com>.
Q*bert Board Game Instructions written by Parker Brothers, published in 1983, in or before December thereof.
Q*bert: Classic Video Game surrealism from the Golden age of Arcade Games written by e-glide, [online] [printed on Mar. 12, 2002]. Retrieved from the Internet at <URL:http://www.users.rcn.com/e-glide/qbert2.html>.
Q*bert Game description written by The Killer List of Videogames [online] [printed by Mar. 12, 2002]. Retrieved from the Internet at <URL:http://ww.klov.com/Q/Q*bert.html>.
Q*bert Qubes Game Description written by The Killer List of Videogames [online] [printed on Mar. 12, 2002]. Retrieved from the Internet at <URL:http://www.klov.com/Q/Q*bert's__Qubes.html>.
Q*bert Video Game Advertisement written by Pennsylvania Gameroom Warehouse [online] [printed on Mar. 12, 2002]. Retrieved from the Internet at <UR:http://www.gameroomwarehouse.com/videogame/qbert.html>.
Q*bert Video Game Advertisement for PlayStation, [online] [printed on Mar. 12, 2002]. Retrieved from the Internet at <URL:http://www.amazon.com>.
Q*bert Game Cartridge Instruction for Atari 2600 Game System written by Parker Brothers, [online] printed on Feb. 12, 2002]. Retrieved from the Internet at <URL:http://www.hasbro.com/default.asp?x=cc__gameandtoyinstructions>.
Q*bert Video Game Cartridge Instructions for Atari Home Computer written by Parker Brothers, [online] [printed on Feb. 12, 2002]. Retrieved from the Internet at <URL:http://www.hasbro.com/default.asp?x=cc__game and toyinstructions>.
Q*bert Video Game Cartridge Instructions for Colecovision Game System written by Parker Brothers, [online] [printed on Mar. 12, 2002]. Retrieved from the Internet at <URL:http://www.hasbro.com/default.asp?x=cc__game and toyinstructions>.
Q*bert Video Game Cartridge Instructions for Commodore 64 Game System written by Parker Brothers, [online] [printed on Mar. 12, 2002]. Retrieved from the Internet at <URL:http://www.hasbro.com/default.asp?x=cc__gameandtoyinstructions>.
Q*bert Video Cartridge Instructions for Intellivision Game System written by Parker Brothers, [online] [printed on Mar. 12, 2002]. Retrieved from the Internet at <URL:http://www.hasbro.com/default.asp?x=cc__gameandtoyinstructions>.
Q*bert Video Game Cartridge Instructions for Texas Instruments 99/4A Game System written by Parker Brothers, [online] [printed on Mar. 12, 2002]. Retrieved from the Internet at <URL:http://www.hasbro.com/default.asp?x=cc__gameandtoyinstructions>.
Red Baron Article written by Aristocrat, published in Strictly Slots in Feb. 2005.
Reelin-n-Rockin Advertisement, published by Aristocrat, published in 1999, in or before December thereof.

Richard Petty Advertisement written by IGT, published in 2000, in or before December thereof.
Roamin Rhinos™ Video Slots Gaming Machine Description, [online] [printed in 2002 in or before December thereof]. Retrieved from the Internet at <URL:http://www.igt.com/GamingGroup/Games/game_detail.asp?toggle=ovr&pid=5.113.120 &type_id=2374&pl=#cnt>.
Roll & Win Advertisement written by WMS Gaming, [online] [printed on Jun. 8, 2001]. Retrieved from the Internet at <URL:http://www.wmsgaming.com>.
Slot Machine Buyer's Handbook, A Consumer's Guide to Slot Machines [In Part] written by David L. Saul and Daniel R. Mead, published in 1998, in or before December thereof.
Slot Machines A Pictorial History of the First 100 Years, 5th Edition [In Part], written by Marshall Fey, published 1983 to 1997, in or before December thereof.
Slot Machines on Parade {In Part] written by Robert N. Geddes and illustrated by Daniel R. Mead, published in 1980, in or before December thereof.
SnapShot Aristocrat Technologies Article, published in Strictly Slots, Aug. 2003.
South Park—Dodgeball Advertisement written by IGT, published in 2000, in or before December thereof.
Spam Article written by IGT, published in 2002, in or before December thereof.
Spell Binder Advertisement written by IGT, published in 2000, in or before December thereof.
Spin Til You Win Game Description, written by IGT, published in 1996, in or before December thereof.
Stars, Bars and Bones Game Description written by P & M Coins, Inc., available 1997, in or before December thereof.
Super Cherry Advertisement written by IGT, published in 2001, in or before December thereof.
Take Your Pick Advertisement written by IGT/Anchor Gaming, published in 1999, in or before December thereof.
Take Your Pick Article published by Strictly Slots in Mar. 2001.
Texas Tea Advertisement written by IGT, published in 2000, in or before December thereof.
The Creation of Q*bert written by Warren Davis, [online] [printed on Mar. 12, 2002]. Retrieved from the Internet at <URL:http://www.coinop.org/features/qbstory.html>.
The History of Q*bert written by Jeff Lee, [online] [printed on Mar. 12, 2002]. Retrieved from the Internet at <URL:http://www.users.aol.com/JPMLee/qbert.htm>.
Top Cat Brochure written by WMS Gaming, Inc., published prior to 2001, in or before December thereof.
Top Dollar Brochure written by IGT, published in 1998, in or before December thereof.
Treasure Tunnel, Treasure Wheel Brochure written by Sigma Game, Inc., published prior to 2001, in or before December thereof.
Vision Series™ /Good Times™ written by IGT, published in 1999, in or before December thereof.
Wheel Poker Article written by Anchor Games, published in Strictly Slots Nov. 2000.
Wild Bear Salmon Run Advertisement, written by IGT, published in 2003, in or before December thereof.
Winning Streak Website Description written by WMS Gaming, Inc. (website) [Retrieved from the Internet on Mar. 21, 2001].
X Factor Brochure and Website page written by WMS Gaming, Inc., published in 1998, in or before December thereof.
Yahtzee Bonus Advertisement written by Mikohn Winning Solutions Worldwide, published in 1999, in or before December thereof.
Yahtzee Video Game Advertisement written by Mikohn Winning Solutions Worldwide, published in 1999, in or before December thereof.

* cited by examiner

| | | | | |
|---|---|---|---|---|
| 1-1 PWC | 1-2 | 1-3 | 1-4 | 1-5 |
| 2-1 | 2-2 PWC | 2-3 | 2-4 PWC | 2-5 |
| 3-1 | 3-2 | 3-3 | 3-4 | 3-5 PWC |

*Fig. 3a*

| | | | | |
|---|---|---|---|---|
| 7 | Bell | Bell | Bell | Bell |
| Orange | 7 | Bell | 7 | Grapes |
| Grapes | Cherry | Orange | Bell | 7 |

*Fig. 3b*

| | | | | |
|---|---|---|---|---|
| Bell | Bell | Bell | Bell | Bell |
| Orange | 7 | Bell | Bell | Grapes |
| Grapes | Cherry | Orange | Bell | 7 |

*Fig. 3c*

VIDEO GAMING SYSTEM WITH WILD CARD SYSTEM AND BONUS SYSTEM

CROSS REFERENCES TO RELATED APPLICATIONS

This application is related to the following commonly owned co-pending patent applications: "GAMING DEVICE HAVING DUAL EVALUATION SCHEME" filed on Oct. 13, 2000 having U.S. patent application Ser. No. 09/687,689; "GAMING DEVICE HAVING TRANSFORMABLE WILD SYMBOLS OR CARDS WITH WILD SIGNAL INDICATORS" filed on Sep. 20, 2001 having U.S. patent application Ser. No. 09/957,305; and "GAMING DEVICE HAVING EXTENDER SYMBOLS" filed on Jun. 9, 2002 having U.S. patent application Ser. No. 10/191,197; "GAMING DEVICE HAVING RESULTANT WILD SYMBOLS," filed on Jul. 9, 2002, having U.S. patent application Ser. No. 10/191,154; "GAMING DEVICE HAVING WILD INDICATORS," filed on Sep. 21, 2001, having U.S. patent application Ser. No. 09/960,883; "GAMING DEVICE WITH WILD ACTIVATION SYMBOLS AND WILD TERMINATION SYMBOLS," filed on Sep. 26, 2001, having U.S. patent application Ser. No. 09/964,102; "GAMING DEVICE HAVING A VARIED WILD SYMBOL IN A BONUS GAME," filed on Sep. 12, 2002, having U.S. patent application Ser. No. 10/243,512; "GAMING DEVICE HAVING SYMBOLS WITH TRANSFORMATION PROBABILITIES," filed on Sep. 26, 2002, having U.S. patent application Ser. No. 10/255,880; and "GAMING DEVICE INCLUDING A GAME HAVING A WILD SYMBOL RELATED AWARD," filed on Jul. 31, 2003, U.S. patent application Ser. No. 10/633,391.

BACKGROUND OF THE INVENTION

1. Field of the Invention

The present invention relates to video gaming apparatus, methods of play in video gaming apparatus, and novel features used in the playing of video games, especially video games with bonus features.

2. Background of the Art

Wagering games (e.g., roulette, craps, slots, video poker, table card games, and gaming machines or computers using gaming software), including those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,078,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired positive attributes of wagering games outlined above are in large measure provided by the method and apparatus for a wagering game in accordance with the present invention. The game is uncomplicated, exciting and provides the opportunity for players to make multiple wagers, choices regarding those wagers and the possibility of a separate wager and entry fee for a bonus pay-off and a super jackpot pay-off.

The quest for gaming instrumentalities which will provide greater game interest and entertainment among players who wager is an ongoing odyssey. Gaming instrumentalities, particularly "progressive" type slots machines, have provided a two-tiered system in an attempt to continuously stimulate players to play a primary game in hopes of winning an extraordinary and large progressive jackpot. However, these types of gaming machines do not vary significantly from their predecessors and can fail to maintain player stimulus as a result of the lack of interaction the player has with the game in attempting to win the progressive jackpot. As a consequence, players can become disinterested in the gaming experience and gain a perception of being a passive observer of the progressive jackpot. Furthermore, after a progressive jackpot has built up to an extraordinary level and has been awarded to a player, there is a sharp drop off in the stimulus provided to players by these progressive types of machines until the pool of money builds back up.

Wagering games, and especially video wagering games that comprise both a first and second tier of games are also known on stand alone machines or in conjunction with a bank or group of machines. For example, the patent to Marnell, II (U.S. Pat. No. 5,393,057) teaches the use of a poker game or reel game for the primary game and a bingo type game as a secondary game. Certain outcomes from the primary game are reflected in the secondary game and, upon the occurrence of orienting the reflected values from the first game to the second game in a pre-agreed upon pattern (resulting in bingo), a secondary award is made to one or more players responsible for the "bingo". Thus, these types of games also fail to maintain player stimulus as a result of the player being a passive observer of the secondary game.

It is well known in the gaming industry that bonus games attract and keep players at a gaming machine. The bonus game is typically a gaming machine or a random selection device having a gaming play that is enabled by a bonus qualifying signal from an underlying or primary gaming machine. A wide variety of bonus games, features, and devices are known, with a non-comprehensive list of some of those games being set forth below. Other bonus games include an additional game feature contained within a single gaming machine.

The conventional WHEEL OF GOLD® and WHEEL OF FORTUNE® slot casino games incorporate a single play bonusing feature. A rotating wheel is activated by the player depressing a bonus spin button when certain indicia appears on the reels of the slot game and is used to award bonus payouts in a spin of the wheel. A separate multiplier may be used to multiply the bonus payouts. After the bonus spin, play resumes in the underlying gaming machine. These games are commercially available from Anchor Gaming and International Game Technology, respectively and are disclosed in U.S. Pat. Nos. 5,823,874 and 5,848,932.

In EP 0 874 337 A1, "Gaming Machine with Bonus Mode" published Oct. 10, 1998 and owned by WMS Gaming, Inc., a bonus game involving multiple plays is presented for an underlying gaming machine such as a slot machine. Here a Bernoulli trial procedure is used to allow a player to repeatedly play a high odds bonus game (such as another slot game) and receive awards until a losing combination occurs (i.e., winning until losing). The hit rate in the bonus game is greater than 50% (preferably higher than 70%) which results in a much lower hit rate in the underlying game. This hit rate difference causes the player to endure the low hit rate of the underlying slot game in order to qualify for the high hit rate of the bonus game. The length of the bonus game is longer when the hit rate for the bonus game is higher. This bonus feature allows a player to win each bonus game and collect winnings until the player receives a losing combination (i.e., losing until winning). This is a variation of WMS Gaming's earlier bonus feature trademarked JACKPOT STAMPEDE™ which allowed the player in the bonus game to continually spin the bonus reels until receiving a winning combination. The recognized shortcoming with this earlier bonus feature was that the player's expectation of receiving meaningful bonus awards is crushed since the first winning combination to be hit is statistically a small award (i.e., a cherry). Other high odds and "win till you lose" bonus games are found in UK Patent Application GB 2 180 087 A published Mar. 18, 1987 and GB 2 084 371 A published Apr. 7, 1982.

U.S. Pat. No. 6,004,207 describes a spinning reel slot machine that gives a multiplied payoff when certain conditions are fulfilled. Wins that include a special symbol on the pay line are multiplied by an incremental multiplier when the machine is in a particular mode. A counter value is increased by one every time a second special symbol appears on the visible sections of the reels. Whenever the counter reaches a predetermined value, the counter is reset and the multiplier is increased. Whenever a multiplied payout occurs, the multiplier is reset to a minimum value. An "XFACTOR" may act as a wild card for reel slot symbols and may also include other functions in the play of the game.

U.S. Pat. No. 5,980,384 describes an embodiment of the invention in which the player initiates a round of a reel slot type machine game (often referred to as a "spin" or "play") by pulling the slot machine handle or pushing a button and waiting for the reels to stop spinning. If a row of common symbols appears in the primary game, and the symbols may include wild card symbols such as Jokers, the player has a win. In variants of the primary game where there are multiple rows of symbols displayed, if a column or diagonal line of common symbols appear in the primary game, the player has a win or gains some other game advantage.

U.S. Pat. No. 5,944,315 discloses a card game that may be played in video format where a player makes a wager. After three cards are dealt face down to the player and two cards are dealt face up to a dealer, the player chooses either to continue the risk of the wager, surrender and forfeit half of the wager, double the wager or triple the wager when the two face up cards are a pair. When the player does not choose to surrender, the player is dealt two additional cards. The player designates one of his cards as a Joker whereby the player has a Poker hand comprised of four cards and a Joker. The dealer is dealt three additional cards. The dealer designates one of his cards as a Joker whereby the dealer has a Poker hand comprised of four cards and a Joker. A payout is made to the player when the player's hand has a rank that is at least as high as the rank of the dealer's hand. The player may participate in ajackpot by contributing money to ajackpot pool prior to cards being dealt. A payout from the pool is based upon the rank of the player's hand.

U.K. Patent Application GB 2 222 712 A published Mar. 14, 1990 sets forth a slot machine main game interconnected with a slot machine secondary game. The player has the option of pushing button 18 which debits his credit meter by the appropriate amount to play the secondary game such as another slot game. Hence, the player must gamble an amount in order to play the bonus game.

U.S. Pat. No. 6,059,658 describes a device and method for playing a primary and a secondary bonus game. The device includes a primary game device and a secondary game device having a display having five concentrically arranged wheels each having an indicia of an Ace, King, Queen, Jack, Ten and a wild symbol. In response to receiving a pre-selected bonus outcome during play of the primary game device, the secondary game device is actuated to rotate the wheels and randomly present an indicia from each wheel at a pay line as a secondary outcome. The outcome of the secondary game device can be used as an additional award or to multiply the award for the bonus outcome in the primary game.

U.S. Pat. No. 5,393,057 pertains to an electronic gaming apparatus and method therefore wherein each play in the bonus is the result of successive underlying game play. The invention teaches the use of an electronic primary gaming device such as a poker or a slot machine and an electronic secondary gaming device based on bingo. When a winning combination such as three queens appears in the primary game, a space in the bingo matrix is turned over to reveal a bingo symbol. Play continues on the primary game until a winning sequence occurs in the bingo game. The right to play the bingo secondary game does not occur unless the player inserts three or more coins into the primary game. Play continues until the game achieves a bingo in which case the player receives a prize.

UK Patent Application GB 2181 589 A published Apr. 27, 1987 pertains to a slot machine having a jackpot feature whereby the prize value is transferred between separate jackpot displays as successive games are played. Some of the reel symbols are overprinted with a number and when that number lands on the pay line, it is used to climb a ladder. The ladder enables the player to obtain one or all of the prizes in the upper portion of the slot machine. For example, if the overlaid number lands the player on a first playing level, then the player receives all three prizes. If the overlaid number lands the player on a second level, then the player can select which one of the three prizes to receive. If the player lands on a third level, then it becomes a game of skill to select which of the three prizes he selects. Finally, if the player lands on a fourth level, then the prize is randomly selected. The prize may also be randomly doubled. U.S. Pat. No. 5,560,603 sets forth a plurality of slot machines interconnected to an electronic controller which displays a separate race game. Each time a particular predetermined combination of indicia appears in the display of a particular slot machine, a signal is generated from the slot machine that advances the racing element through a particular predetermined distance. If the player's horse reaches the finish line before a timer display times out, then the slot player wins an additional prize. The players in this patent are not racing against each other, but against a clock.

U.S. Pat. No. 5,823,534 discloses a bingo format of game with a wild feature. A bingo game is played by a plurality of players employing a table having respective player stations thereabout. The game permits each player to select each of his or her numbers to be matched during play by randomly drawn numbers, including a wild designation which each player may deem to match one of his or her selected numbers, and the game is permitted to progress at multiple levels of play notwithstanding the occurrence of prior bingos in the game being played.

Many video gaming systems provide wild symbols, almost always wild cards, in the play of their games. Examples of wild symbol games include, but are not limited to, U.S. Pat. Nos. 6,007,066; 5,882,259; 5,823,873; 5,868,618; 5,868,619; 5,816,915 and 5,489,101.

U.S. Pat. No. 5,332,228 describes an improved stud poker game that requires no decisions from the player after the initial bet is placed. Each band has one guaranteed wild card that appears at a card position which is predetermined, and shown to the player, before the player's cards are dealt. In addition to the one guaranteed wild card, all like-valued cards in the hand are also wild. Also, there are a number of novel and entertaining ways to determine the wild card position. The game is adaptable to both video play and table play formats.

U.S. Pat. No. 5,308,065 describes a casino table card game where a player, after making a wager, is dealt, face-up, a hand of five cards that is placed in a player-hand area. The player also receives a solitary card, which is dealt face down in a single-card area. The player then has a chance to improve the ranking of the five-card hand by discarding up to five cards and replacing them with an equal number of new cards. After the player rearranges the five-card hand, the solitary card is turned face-up and all the cards in the player's hand that have the same face value as the solitary card are designated wild. The ranking winnings are calculated according to a statistical pay table.

Australian Patent Application No. 18618/97, filed 28 Feb. 1997, and published 16 Sep. 1997 and Australian Petty Patent No. 686556, filed 29 Oct. 1997 and granted 5 Feb. 1998, both titled "Slot Machine With Roaming Wild Card" and assigned to Aristocrat Leisure Industries Party LTD describes a slot machine and method play in which there may be a triggering predetermined event in a reel-slot type (including video formats) wagering game. The triggered event is the display of a wild card symbol in a first display location. The wild card symbol is then progressively moved, to one space at a time to a predetermined number of other display positions. The display event of the wild card may include a symbol (a penguin is described in the patent application) that 'walks' from space to space on the reel, with any awards determined for the single wild symbol being positioned at each location on the screen. Among the most detailed sequence of events employed in one embodiment comprise the steps of showing a triggering symbol to initiate the progressively moving wild symbol feature. The number of lines and amount of wager are carried over. Sounds accompany the progressively moving wild symbol feature. The moving wild symbol changes back-and-forth between images (e.g., an iceberg and a penguin). The win meter increments for each partial pay feature.

SUMMARY OF THE INVENTION

A novel bonus feature is provided for a video gaming apparatus of the reel-slot-type configuration is provided. The bonus events are triggered by the appearance of one or more preselected symbols on the display. Upon the happening of a triggering event, at least one randomly selected position on the game display is designated as a wild symbol position. The symbols appearing in the designated wild symbol positions are converted from standard game symbols to wild symbols. Wild symbols are then displayed in the wild symbol positions. The game results are then evaluated to determine if winning combinations of symbols have been provided by the original symbols and/or the addition of wild symbols by operation of the gaming apparatus and gaming method.

In one example of the invention, the screen display in the reel-slot-type video game is a video representation of five horizontally aligned reels. Each "reel" shows at least three symbol positions (at least three because blank areas between symbols may be used as a display position), aligned vertically, with five reels aligned horizontally, for a total of fifteen symbol positions (not including blank spaces) on the screen display.

According to the invention, between one and the maximum number of symbol positions (in this case, fifteen) are displayed. All fifteen symbol positions may be potentially wild symbol positions.

Upon the happening of a triggering event, a random number generator is employed to determine how many wild symbol positions are assigned in a given bonus round or regular play round. The number of wild positions and the location of the selected number of wild positions are randomly determined according to the invention.

In order to enhance the excitement of the game, and to create a greater feeling of anticipation, each wild symbol position is preferably revealed to the player one at a time, rather than simultaneously. In another example of the invention, all wild symbol positions are simultaneously revealed. In other examples of the invention, groups of wild symbol positions are simultaneously revealed.

Once the wild symbol positions are identified, the appearance of the position changes into a wild symbol, or goes blank then changes to a wild symbol according to examples of the invention. The wild symbol positions can be revealed to the player a number of ways. In one example, the game symbol first disappears and the wild symbol position is blank prior to the appearance of the wild symbol. In other examples, the game symbol transforms into the wild symbol. In yet another example, a visual marker, such as a dog bone or other symbol appears somewhere on the selected wild symbol position as an overlay or in addition to the game symbol. As a separate step, the marker and game symbol disappear and are replaced with a wild symbol. The disappearance may be a morphing from one symbol (the visual marker or visual marker and game symbol) into the wild symbol. Although morphing is preferred, a sharp, non-continuous change from the one symbol to the wild symbol may also occur.

According to the invention, the game is then scored in the usual manner, by comparing the game symbols to a look up table. The player is typically paid a payout for preselected outcomes that can be line pays, scatter pays, or combinations thereof.

BRIEF DESCRIPTION OF THE FIGURES

FIG. 3 shows a series of reel images that can occur in the play of the game.

FIG. 3*a*) shows a blank set of reel positions with potential wild symbol combination positions.

FIG. 3*b*) shows a set of images on reels that produce a wild card result based on the blank set of FIG. 3*a*).

FIG. 3*c*) shows a set of images on reels where the wild card result of FIG. 3*b*) has altered the outcome of the game by altering symbols in a manner that improves an actual award.

DETAILED DESCRIPTION OF THE INVENTION

Figure 1:
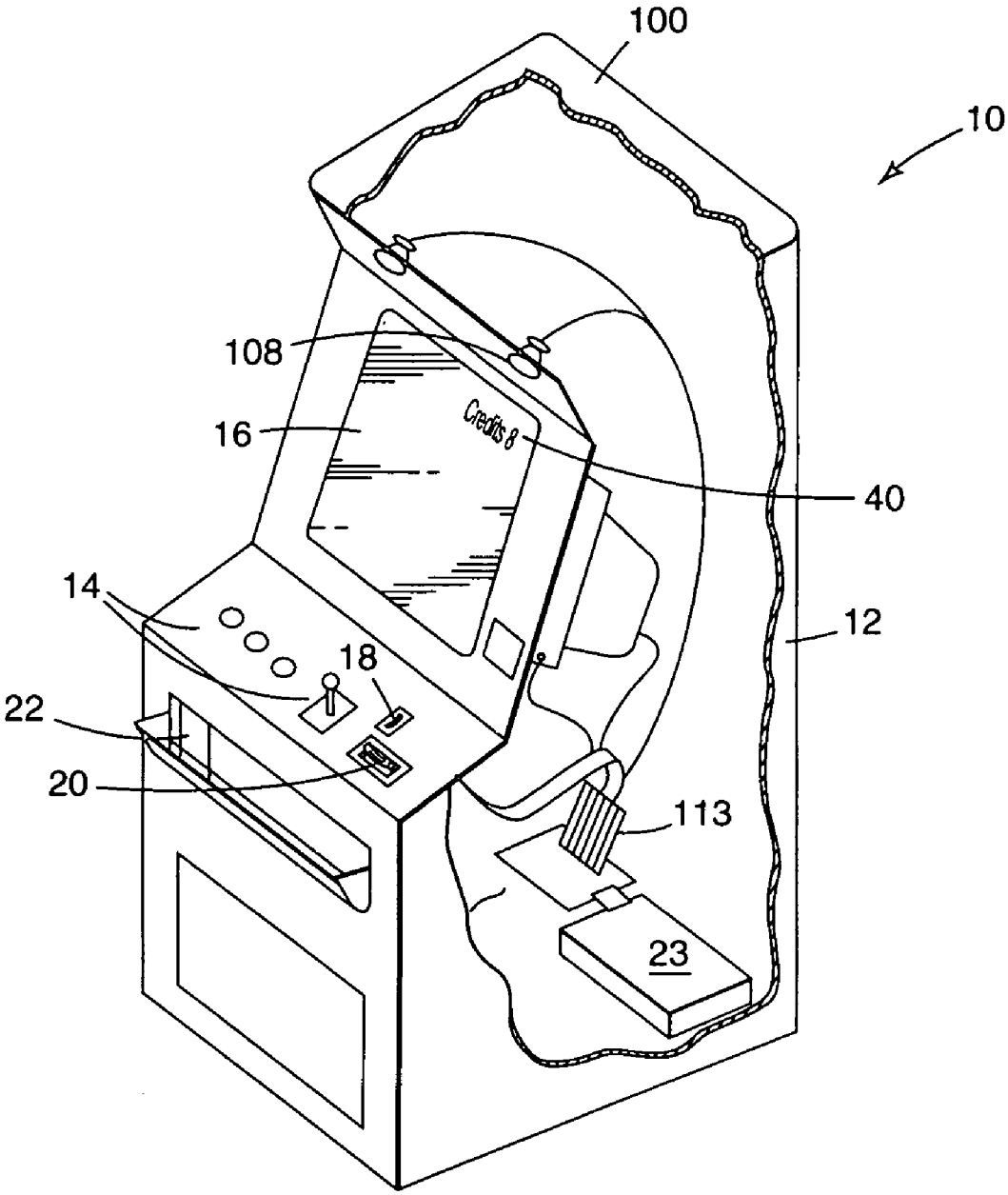
FIG. 1 shows a general gaming apparatus and housing for a gaming device according to the present invention.

Video games have provided wild card symbols to increase the frequency of winning combinations or to add additional excitement or entertainment to the play of the games. The traditional manner of providing wild cards or wild symbols is to have the wild symbols randomly displayed on the screen in the play of the game. When the wild symbol appears, it is wild only in that position where the wild card appears, or may cause other symbols (usually cards) of a similar rank or value to be come wild. In poker games where wild cards are available, wild cards (e.g., deuces or jokers) are randomly displayed on the screen. The wild cards are not position-sensitive in that they may become any card that maximizes the value of the hand, and the wild card may be used in any position in the hand (so that runs or straights are possible), rather than the cards being wild only in the position in which the card appears.

In the play of prior art reel-type games, the wild cards, in those few instances where they are used in reel-type games, are position-sensitive and are wild only in the specific position where they appear. For example, if the wild symbol were not position-sensitive, where a cherry in the first position would pay two wagered units, the appearance of a wild symbol in any position would always provide a winner. This is a desirable outcome for the player, but the effect on the house hold would be significantly affected, and the programming would tend to reduce the frequency of appearance of the wild symbol to maintain the house hold at a favorable level. This would reduce the frequency of the wild symbol, and this would reduce the entertainment value of the play of this feature.

A method of playing a video wagering game according to the present invention comprises a player placing a wager on a reel-type video wagering game; displaying a set of randomly selected game symbols on a display area within areas that indicate frames or positions on a reel-type video wagering game; upon the occurrence of a predetermined event, randomly selecting and/or identifying one or more frames or positions as a wild position; converting the wild positions to wild symbols; and determining game outcomes based on actual symbols originally displayed and any wild cards. The selecting and/or identifying the one or more frames or positions (position-selected wild symbol position) may include providing a visual marker or special symbol (hereinafter generally referred to as a "visual marker") that is itself not a wild symbol, but which indicates that at least that frame or position will later be converted into a wild symbol. The appearance of the visual marker may also be used to indicate that other visual markers in specific positions or any position will also become wild symbols.

It is an aspect of this invention that the playing of a segment of a game with the position-selected placement of the wild card may be a bonus event after the occurrence of a predetermined event. A predetermined event means only that the designers of the play of the bonus feature of the game have set a condition precedent to entry into an aspect of play that incorporates the wild feature of the present invention. The predetermined event may, by way of non-limiting examples, include at least any one or combination of a winning event, a non-winning event, a combination of winning events (e.g., three-wins-in-a-row), a combination of losing events (e.g., three losing-events-in-a-row), the appearance of a special trigger symbol (either a single symbol or multiple symbols), the appearance of one or more special trigger symbols in particular or general positions (e.g., one trigger symbol in space 1-1, one trigger symbol in column 1, two trigger symbols in column 1 and column 5, two trigger symbols in positions 1-1 and 1-5, etc.). After the occurrence of the predetermined event, the software or hardware of the apparatus randomly selects (e.g., by a random number generator) at least one position (the random number generator may also select the number of frames where wild symbols are selected, with a 3×5 reel-slot image there are up to fifteen positions) where the wild symbol or a wild symbol will be positioned. After selection of the number and positions of symbol displays, wild symbols and/or the placement of wild symbols on the screen or into the operation of that game, the wild symbols may be used in resolving the play of the game. Wild symbols may alternately be used as a bonus feature with the original symbols from the first segment of the game. Or, the wild symbols may be used in a bonus feature where the position and location of the position-selected wild symbols or wild cards are retained from the process of random selection after the predetermined event, and then the open frame or frames where no wild symbols have been selected are randomly filled with non-wild symbols or combinations of non-wild symbols and wild symbols.

The effect of the wild symbol events in the practice of this invention may also be implemented in a number of different ways. For example, a sequence of events where the predetermined event comprises a winning event will be first considered. After the first predetermined event has occurred, an amount of payout is determined. That payout may be resolved at that point (e.g., tokens paid out or credits added to the credit total) or the payout may be carried over and incremented in bonus play or used as a factor (multiplicand) in the bonus feature. For example, if the predetermined event comprises a combination of symbols that provides a payout of 10 credits, the 10 credits may be retained and bonus amounts won in the wild card segment are added to the retained 10 credits, or factors may be awarded in the wild card segment and used as multipliers against the retained 10 credits. The additive bonus or multiplier bonus effects may be determined by special pay tables for wild card-included bonuses. For example, since wild cards will greatly increase the frequency of payouts and the relative rank of payouts, the awards for payouts for specific combinations (e.g., five sevens) would have to be diminished in comparison to non-wild card payouts, as is typical in wild games. The bonus payouts may also be limited to horizontal pay lines or specific pay lines. In this manner, reasonable levels of bonuses will be awarded and a reasonable return or hold for the house will be maintained. A special bonus or jackpot could be awarded where certain events occur (payout combinations on all pay lines, all spaces filled with wild cards, pay combinations of at least a specific rank on each pay line, etc.). Therefore, when the predetermined event includes a winning combination, the original winning event may be immediately resolved, carried over, incremented by a specific bonus amount determined in wild symbol play, or incremented by a multiplier determined in the symbol play aspect of the game.

Figure 2:
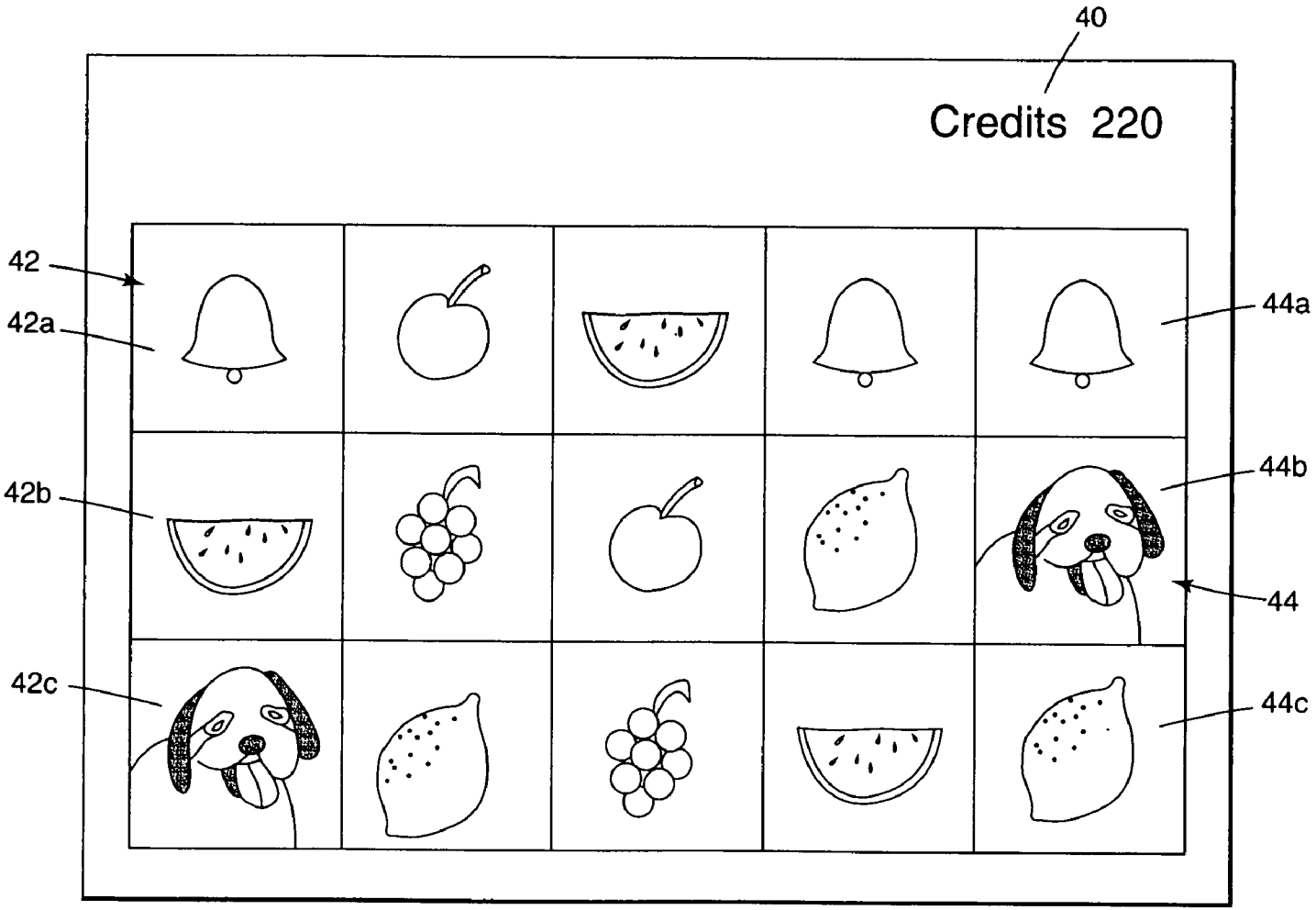
FIG. 2 shows the images displayed on a five reel, three row slot-type device, with a visual marker of a wild card shown in two frames.

FIG. 1 illustrates a reel-slot-type video gaming device of the present invention. The gaming device 10 has a cabinet 12, player controls 14, a screen display 16, a coin acceptor 18, bill validator 20, coin hopper 22 and a computer system 23. The computer system typically includes a microprocessor and memory. The microprocessor accesses operating system software and game application software stored in memory. The computer system 23 is also equipped with a random number generator, and the random number generator is used to randomly select game symbols that appear on the screen display 16. As shown in FIG. 2, the screen display in one embodiment is a five reel slot simulation with a total of fifteen symbol positions, respectively.

According to the invention, the player first places a wager by either betting a credit as shown on the credit display 40 (FIG. 1), or by placing a coin in the coin acceptor 18. The game computer 23 either automatically or in response to manipulation of player controls 14 initiates a random symbol selection process. The selected symbols are then displayed on the display screen 16. According to conventional game play, the game symbols are compared to a look-up table (a pay table), and the player is awarded credits if the displayed symbols comprise a winning pay line or scatter pay combination.

According to one embodiment, the bonus event is triggered by the appearance of a designated symbol, such as a "BIG DOG" shown in FIG. 2 on the first and fifth reels 42, 44. Since the appearance of a BIG DOG symbol can be on any of the symbol positions 42*a*, 42*b*, 42*c* and 44*a*, 44*b*, 44*c*, the triggering event in this example is a "scatter" arrangement. According to one method of play, the trigger symbol must appear on the first and fifth reels. In this sense the triggering event is at least a positional scatter arrangement, where only the visual markers in specific positions are converted to wild symbols and that only those visual markers in those specific positions do become wild symbols. In other examples of the invention, the triggering event can be the appearance of one or more trigger symbols anywhere on the display, or in a particular position on the display. The trigger symbol may be the visual marker or an independent trigger marker. That is, the visual symbols may have the potential of being wild, but are converted to wild symbols only where the trigger marker appears on the same screen.

The triggering event can be a winning event for the player or in the alternative, simply be an event that advances the player to the bonus round of play. In the example here described, the triggering event produces a payout. Upon the occurrence of the BIG DOG symbol on specific locations or in a specific order, in this case the appearance of the BIG DOG symbols on the first and fifth reel, a payout is awarded, and the bonus feature is then activated. The payout combination on the screen may alternatively be independent of the activation of the bonus feature. The bonus feature in this example progresses as follows. After the occurrence of the triggering event (e.g., the appearance of the BIG DOG symbol on the first and fifth reels), the random number generator selects a random number (e.g., with a trigger event of two BIG DOGS, there are thirteen remaining frames available where wild symbols may be placed, so the random number may be between 0 and 13, usually 1 to 13) and random positions for that number selected, and inserts wild symbols in those randomly selected positions. The game would then be resolved by converting or reading the wild symbols as symbols that would maximize payouts or bonuses. Where a wild symbol in a particular position could influence payouts in two different pay lines, the system may treat that position in a number of different ways.

The apparatus could determine what single symbol would maximize the payout or could read the position as both symbols, providing two different winning pay lines. Alternately, the wild symbol could transform into a game symbol representing the optimal payout. These are software or programming issues in the control of the game designer. The formatting could even have the apparatus decline to provide a win where there are two potential wins from a wild symbol in a specific position, although this would probably be a form of play that is disagreeable to players.

Another format of play could include a method of playing a video wagering game, comprising: a player placing a wager on a reel-slot-type video game; displaying a plurality of randomly selected game symbols on a display, each symbol appearing in a designated symbol position; upon the occurrence of a predetermined triggering event, randomly selecting at least one symbol position as a wild symbol position; converting each symbol displayed within each selected wild symbol position to a wild symbol; retaining wild symbols in their respective positions and randomly distributing at least some non-wild symbols into frames in the display to perform a second gaming event; and determining game outcomes based on the displayed game symbols and wild symbols in the second gaming event.

The displayed reels will normally provide at least one row of three columns. More typically, the display will provide at least two rows of three columns of symbols, at least three rows of three columns of symbols, at least three rows of four columns of symbols, at least three rows of at least five columns of symbols, at least four rows of four columns of symbols or at least five rows of at least five columns of symbols. It is preferred in the practice of the invention to have at least three rows with five columns of symbols.

Referring now to FIG. 3, the bonus event involves the following range of procedures, which is implemented by software, circuitry, hardware, and other intelligent systems embedded in the apparatus or connected to the apparatus (as in a centrally controlled system of video games with a central computer). A three row-five column reel-type system will be used in the discussion, although as previously noted, systems with different distributions and formats can be used in the practice of the invention. In describing the reel-type three-row by five-column video display, the frames will be described in terms of the 3×5 matrix with positions identified by the number of the row and then the number of the column. For example, the third frame (third column) in the first row will be identified as position 1-3, and the fifth frame (fifth column) in the third row would be identified as position 3-5.

A player engages the apparatus by applying a wager to the system by coin, currency, token, credit, charge or the like. A fundamentally conventional reel-slot game is engaged in which the symbols within each frame change, usually with the changes being displayed to simulate the rotation of reels in the columns of symbols. The symbols may be virtually stopped within each frame or position (1-1 through 3-5) either by appearing to stop each frame or position or by stopping columns with the three consecutive frames in that virtual columnar reel stopping at the same time. The system evaluates the pay lines (including not only traditional row pay lines, but also diagonal pay lines, column pay lines, scatter pays, and non-linear pay lines as is known in the art) to determine if there has been a win or non-win event. Any number of different symbols may be available for each position, usually with at least three, at least four, at least five, at least six, at least seven or at least eight different symbols being available for the respective positions. The number and frequency of specific symbols may vary from reel-to-reel, column-to-column, row-to-row, frame-to-frame, position-to-position, play-to-play, etc. Additionally, newer frequency controls, new probability controls, new outcome controls, new software programs, new algorithms and new formats are available that can assist in varying underlying aspects of the control of the game. Some of these newer controls are exemplified in U.S. Pat. No. 4,448,419 and copending U.S. patent application Ser. Nos. METHOD AND APPARATUS FOR CONFIGURING A SLOT-TYPE WAGERING GAME, Ser. No. 08/989,369, filed Dec. 12, 1997 and METHOD AND APPARATUS FOR CONFIGURING A VIDEO OUTPUT GAMING DEVICE, Ser. No. 08/999,189, filed Dec. 12, 1997.

FIG. 3*a*) shows a blank set of reel positions with plurality of selected wild symbol positions. The positions are identified by the number of the row (1 through 3) and the number of the column (1 through 5). In addition, four positions (1-1, 2-2, 3-4 and 5-5) are identified as having a visual marker or Wild Card (WC) that becomes a wild symbol in those positions. The underlying software or hardware of the gaming apparatus will be programmed to define certain squares as activating positions, or positions where the presence of a WC will enable the WC to actually become a wild symbol. In the display shown in FIG. 3, for example, the programming of the software can provide a number of different effects. The various different scenarios will be analyzed.

In one example, the bonus triggering event is the appearance of a single wild symbol in frame or position 1-1. Upon the occurrence of the triggering event, the number and position of the other WC's is randomly determined, and the WC's or visual markers are displayed on the screen. In the image portrayed for FIG. 3, the organization of WC's would mean that positions or frames 1-1, 2-2, 2-4 and 3-5 would become wild symbols because of the designation of the WC in frame 1-1.

It is also possible that the wild card would be effective only in a position selected by the player at the beginning of a game. The player may be allowed to choose the triggering frame at the beginning of the game, before any symbols have been displayed, adding an additional element of player involvement to the game, similar to the game of Keno. If the determining frame were 3-1, for example, then no WC's would be randomly selected for that round of play with the symbol distribution shown in FIG. 3. If the software required that the conversion of WC's to wild symbols would require that at least two WC's be present in specific positions, a different set of events could occur. For example, if it were required that a WC appear in both 1-1 and 1-5, no WC's would be selected for that round of play with the symbol distribution shown in FIG. 3. It could also be a method of play that where a WC appeared in one of the required spaces, then only that WC would become wild, while if the at least two WC's appeared in the two designated positions, then additional WC's would be selected and converted into wild symbols. In this case, if it were required that a PWC appear in both 1-1 and 1-5 to trigger the selection of one or more additional WC's, then in this event portrayed in FIG. 3, only the PWC in 1-1 would become a wild symbol.

As another alternative, if the required determining positions were positions 1-1 and 3-5, then additional WC's are randomly selected, and randomly assigned to a corresponding number of additional positions. The advantage of the latter form would be the ability to have more numerous WC's displayed on the screen at a given time (allowing a higher frequency of WC's) so that the expectations of the player may be maintained at a higher level because of the frequency of appearance of WC's.

In FIG. 3*b*), the symbol "7" has been used to indicate a WC. In the reel display shown in FIG. 3*b*), the software would then analyze display to determine how the payout could be maximized considering all pay lines. In some screen displays, the visual markers would not change into wild symbols need not change, as changing them would not affect the pay out, even when the symbol becomes a wild symbol. Looking at the symbols in FIG. 3*b*) with only linear pay lines considered to simplify this analysis (within the same column or within the same row), using 2-2 as a wild symbol cannot affect the payout. No matter what that symbol is changed to (either considering it alone or considering it with other WC's), there can be no payout with a pay line through that symbol. On the other hand, with the WC in 1-1 virtually or analytically changed to a bell, a first row pay line goes from a payout of zero to whatever the payout is for five bells. The software in this example would disregard the payout of a cherry in position 1-1, which would be likely to be less than the payout for five consecutive bells. In other words, according to one example of the invention, the wild symbols are used to score each pay line, but only award the highest possible award for each pay line.

Although in one example the visual markers converted to wild symbols retain the appearance of a wild symbol, in another example, the symbols can further "morph" into the actual game symbol that produces the highest payout to clarify how the game is being scored. For example, FIG. 3*c*) shows WC's that have changed into the preferred game symbol yielding the highest payout. It has been assumed that three bells in a column (e.g., column 4) would produce a payout, and the symbol in 2-4 has been changed accordingly. Positions 2-2 and 3-5 have remained unchanged in the display, as there are no changes in those positions that would affect the payout.

Often when the game is configured to pay for multiple pay lines, the WC's will be different, depending on the pay line being scored. For this reason it would be desirable for the WC to retain the appearance of a wild symbol, rather than morphing into the actual symbol represented during scoring. For example, in FIG. 3*b*), the WC in position 2-2 might be scored as an Orange on the center pay line (assuming two oranges establish a payout combination of symbols), and be scored as a grape on a diagonal pay line extending from position 3-1 up through position 1-3 and then across to position 1-5 (assuming two grapes pay a payout).

When the triggering event is the appearance of two BIG DOGS anywhere on the first and fifth reels as shown in FIG. 2, the bonus event is activated. The microprocessor may select a minimum of one additional WC, for a total of at least three wild symbols appearing on the game display and used to score the bonus round. More typically, where the play of this symbol system is used in a bonus play or bonus round, between 5 and 13 wild symbols appear in a given bonus round. It is to be understood that the mathematical probabilities of the game determine the frequency of bonus symbols appearing in each bonus round of play.

In this example, the bonus triggering event is the appearance of a BIG DOG on reels one and five, each BIG DOG functions as a wild symbol in the base game as well as in the bonus round. If for example the random number generator selects five additional positions as wild positions, for that given round of bonus play, the game is scored using the original two BIG DOG wild symbols that carried forward into the bonus round, plus five additional BIG DOGS that appeared in the selected wild positions. Although in this example the triggering symbol is the same wild symbol used in bonus play, the triggering event need not be the appearance of a symbol, as described above. The triggering event could include a predetermined number of consecutive winning or losing outcomes, the appearance of a different symbol or symbols that are not wild symbols, etc. The award of random numbers of random positions of wild symbols may also be carried into play of a regular spin, with or without play of a bonus round as described herein.

After the triggering event, the number and position of the visual markers or WC's are randomly selected. Although a number of methods of displaying the random selections is possible, one method comprises causing the selected positions to go blank, and then be replaced with wild symbols identical to the trigger symbol, such as a BIG DOG. In order to prolong the enjoyment of the bonus round and increase anticipation and excitement, the gaming machine is preferably programmed so that each wild symbol appears one at a time on the display. Alternatively, the wild symbols can appear in groups, or simultaneously.

In another example of the invention, a combination of two or more special wild symbols are provided, where each wild symbol is wild as to only a subset of game symbols. For example, the wild symbols may operate on all symbols except bells. The wild symbols can also be configured so that they do not operate on symbols in special situations. For example, the game designer might choose to have the wild symbols operate on all game symbols except those that may produce a scatter pay.

In yet another example of the invention, a visual marker, such as a dog bone or other symbol appears somewhere on the selected wild symbol position as an overlay or in addition to the game symbol. As a separate step, the marker and game disappear and are replaced with a wild symbol. The particular manner in which the wild symbol position is identified to the player is unimportant.

An Exemplary Operating System

The following discussion is intended to provide a brief, general description of suitable computing environments within which the invention may be implemented. While the invention will be described in the general context of an application program that runs on an operating system in conjunction with an operating platform such as a personal computer, those skilled in the art will recognize that the invention may also be implemented in combination with other program modules. Generally, program modules include code, applets, routines, programs, components, objects, commands, data structure, etc. that perform particular tasks or implement particular abstract data types. Moreover, those skilled in the art will appreciate that the invention may be practiced with other computer system configurations, including hand held devices, multiprocessor systems, microprocessor-based or programmable consumer electronics, LAN (large area networks), WAN (wide area networks), microcomputers, mainframe computers, and the like. Multiple gaming devices may be operated out of a single mainframe or central series of computers. The invention may thus be practiced in distributed computing environments where tasks are performed by remote processing devices that are linked through a communication network. In a distributed computing environment, program modules may be located in both local and remote storage devices.

An exemplary, non-limiting system for implementing the present invention includes a conventional personal computer (also referred to as a client computer), including a processor or micrprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes onto other optical media). The hard disk drive, magnetic disk drive, and optical disk drive may be connected to the system by any mechanism such as a hard disk drive interface, a magnetic disk drive interface, and/or optical disk drive interface, respectively. The drives and their associated computer-readable media provide non-volatile storage for the personal computer. Although the description of computer readable media above includes the hard disk drive, a removable magnetic disk and a removable optical disk, such as a CD, its should be readily appreciated and understood by those of ordinary skill in the art that other types of media which are readable by computer, such as magnetic cassettes, flash memory, flash memory cards, ZIP-disks, digital video disks and tapes, Bernoulli cartridges, and the like, may also be used in the exemplary operating environment.

A number of program modules may be store in the drives and RAM, such as an operating system and a network browsing program module. In general, the network browsing program module is a tool used to interact with other computers over data networks, such as the internet and the World Wide Web. The network browsing program module is also a tool capable of using downloadable program modules, such as the puzzle control module, to direct operation of the personal computer. The drives and RAM may also store other program modules, program data (such as image data, player input data, random number generators, comparator data, look-up tables, and other game play data).

The operating system, in conjunction with the BIOS and associated device drivers, may provide the basic interface between the computer's hardware and software resources, the user, and program modules such as the network browsing software module. A user may enter commands and information into the personal computer through a touch pad, activating buttons, button panels, touch screen surfaces, light wand surfaces, joy sticks, and/or a keyboard, and an input or pointing device such as a mouse. Other input devices may include a microphone (with voice recognition software), game pad, tracking ball (except for direction of the apparent skill function which must be grippable or hand manipulatable, not merely operable by contact with a flat surface of a hand), light gun, scanner, satellite dish, joy stick, light wand, or the like. These and other input devices are often connected to the processor through a serial port interface, such as a game port or a universal serial bus (USB). A monitor or other type of display device (e.g., a public view screen, integrated monitors, serial monitors, grid monitors, and the like, with any imaging format, such as CRT, plasma screen, projection viewing, liquid crystal display, light emitting diode (LED) display, etc.) is also connected to the system bus by way of an interface, such as a video adapter. In addition to the monitor, personal computers used in the gaming industry would typically include other peripheral output devices (not shown), such as peripheral light displays, audio systems, speakers, alarms, and the like.

As discussed earlier, the gaming system of the present invention is embodied in the housing, information storage, gaming modules and the like of the gaming apparatus as software, hardware or a combination of software and hardware. The information for particular games is typically stored in a game control module that essentially provides all of the information and controls and commands and responses in the play of he particular game of the invention. In one exemplary operating environment, the game control module is used in conjunction with a network browsing program module, which is supported by an available operating systems such as Microsoft Corporation's Windows 95," "Windows 98," "Windows NT," Microsoft Office" operating systems, LINUX, UNIX, MacIntosh Operating systems, or the like. However, it should be understood that the invention may be implemented for use with other network browsing program modules and with other operating systems and hardware, such as Microsoft Corporation's "Windows 3.1," "Windows 7.0" operating systems, IBM Corporation's "OS/2" and "AIX" operating systems, SunSoft Corporation's "SOLARIS" operating system, Hewlett-Packard Corporation's "HP-UX" and "RT-UX" operating systems, and the operating systems used in "MACINTOSH" computers manufactured by Apple Computer, Inc.

The above examples have been illustrative of a generic scope of practice for the invention and are not to be taken as limitations on the practice of the invention. Equivalents and alternatives obvious to those skilled in the art in the various relevant arts are intended to be used within the scope and practice of the present invention.

What is claimed is:

1. A gaming device comprising:

at least one display device;

a game operable upon a wager, the game including a plurality of reels displayable by the at least one display device, each of the reels defining a plurality of locations for a plurality of symbols, the reels displaying a plurality of different combinations of the symbols after the reels are spun at least one time, the different combinations being positioned along a plurality of different pay lines;

a plurality of winning conditions associated with a plurality of the combinations;

an award associated with each one of the winning conditions;

at least one wild function which is:

(a) operable on a first one or more of the symbols in a first one of the combinations, the first one or more symbols being positioned along a first one of the pay lines;

(b) inoperable on a second one or more of the symbols in a second one of the combinations, said second one or more symbols being positioned along a second one of the pay lines, the first combination being different from the second combination; and (c) operable to increase a likelihood of meeting at least one of the winning conditions;

at least one input device operable by a player;

a triggering event that occurs in response to a designated one or more of the symbols being displayed during the game; and a processor in control of the at least one display device, the processor programmed to operate with the at least one display device and the at least one input device to:

(a) receive a first input signal from the input device, the first input signal corresponding to the wager;

(b) display the reels;

(c) receive a second input signal from the input device, the second input signal corresponding to a selection of at least one of the plurality of different pay lines;

(d) receive a third input signal from the input device, the third input signal corresponding to a selection of at least one, and less than all, of the locations of the reels, the third input resulting in at least one selected location and at least one non-selected location, the third input signal being performed independent of the second input signal;

(e) display a first spin of the reels resulting in a display of a plurality of the symbols at a plurality of the locations;

(f) determine whether the triggering event occurs;

(g) in response to an occurrence of the triggering event, visually distinguish at least one of the locations;

(h) display a second spin of the reels resulting in a display of a plurality of the symbols at a plurality of the locations;

(i) for the second spin of the reels, determine whether the at least one visually distinguished location is: (1) the at least one selected location; or (2) the at least one non-selected location;

(j) if the at least one visually distinguished location is the at least one non-selected location, determine if any of the winning conditions are present without taking into account the wild function;

(k) if the at least one visually distinguished location is the at least one selected location:

(x) cause any of the symbols displayed at the at least one visually distinguished location to have the wild function; and (y) determine if any of the winning conditions are present, taking into account any wild function of any of the symbols displayed at the at least one visually distinguished location; and (l) provide the player with any of the awards associated with any of the winning conditions that are present.

2. The gaming device of claim 1, which includes at least one instruction executable by the processor to: (a) cause a plurality of first symbols to have the wild function; and (b) cause each of the first symbols to be displayed one at a time.

3. The gaming device of claim 1, which includes at least one instruction executable by the processor to simultaneously cause any of the first symbols displayed at said at least one selected location to have the wild function.

4. The gaming device of claim 3, wherein any of the first symbols displayed at said at least one selected location has an image, the gaming device including at least one instruction executable by the processor to cause the display device to simultaneously replace said images with designated images associated with the wild function.

5. The gaming device of claim 1, wherein each one of the pay lines includes a pay line selected from the group consisting of a horizontal pay line, a row pay line, a column pay line and a diagonal pay line.

6. The gaming device of claim 1, wherein the gaming device has a data storage device which stores at least one instruction, the instruction being executable by the processor to communicate with a server over a network, the server storing data associated with the game.

7. A gaming device comprising:

at least one display device;

a game operable upon a wager, the game having a plurality of reels displayable by the at least one display device, each of the reels: (i) defining a plurality of locations for a plurality of symbols; and (ii) displaying a plurality of different combinations of the symbols, the displayed symbols being of different types, the symbols being groupable to form a first group of symbols and a second group of symbols which is different from the first group of symbols, the first and second groups of symbols being positioned along a plurality of different pay lines;

a plurality of winning conditions associated with a plurality of the combinations;

an award associated with each one of the winning conditions;

at least one input device operable by a player; and a processor in control of the at least one display device, the processor programmed to operate with the at least one display device and the at least one input device to:

(a) receive a first an input signal from the input device, the input signal corresponding to the wager;

(b) display the reels;

(c) receive a second input signal from the input device, the second input signal corresponding to a selection of at least one of the plurality of different pay lines;

(d) receive a third input signal from the input device, the third input signal corresponding to a selection of at least one, and less than all, of the locations of the reels, the third input resulting in at least one selected location and at least one non-selected location, the third input signal being performed independent of the second input;

(e) display a first spin of the reels resulting in a display of the first and second groups of symbols at a plurality of the locations;

(f) determine whether a triggering event occurs;

(g) in response to an occurrence of the triggering event:

(i) visually distinguish at least one of the locations; and (ii) apply a wild function to at least a first one of the symbols in the first group after said first symbol is displayed at the at least one selected location, the first symbol being positioned on a first one of the pay lines, wherein the wild function is:

(x) operable on at least one of the other symbols of a different type than the first symbol, the other symbol being within the first or second group, and (y) inoperable on one or more of the symbols in the second group, said one or more symbols being positioned along a second one of the pay lines, and (h) display a second spin of the reels resulting in a display of the first and second groups of symbols at a plurality of the locations;

(i) for the second spin of the reels, determine whether the at least one visually distinguished location is: (1) the at least one selected location; or (2) the at least one non-selected location (j) if the at least one visually distinguished location is the at least one non-selected location, determine if any of the winning conditions are present without taking into account the wild function;

(k) if the at least one visually distinguished location is the at least one selected location:

(x) cause any of the symbols displayed at the at least one visually distinguished location to have the wild function; and (y) determine if any of the winning conditions are present, taking into account any wild function of any of the symbols displayed at the at least one visually distinguished location; and (l) provide the player with any of the awards associated with any of the winning conditions that are present.

8. The gaming device of claim 7, wherein each one of the pay lines includes a pay line selected from the group consisting of a horizontal pay line, a row pay line, a column pay line and a diagonal pay line.

9. The gaming device of claim 7, wherein the gaming device has a data storage device which stores at least one instruction, the instruction being executable by the processor to communicate with a server over a network, the server storing data associated with the game.

10. The gaming device of claim 7, which includes at least one instruction executable by the processor to: (a) cause a plurality of the symbols to have the wild function; and (b) cause each of said symbols to be displayed one at a time.

11. The gaming device of claim 7, which has a data storage device storing at least one instruction executable by the processor to cause each of the symbols with the wild function to be visually distinguished from the symbols which do not have the wild function.

12. The gaming device of claim 11, wherein each of the visually distinguished symbols has an image, the data storage device having at least one instruction executable by the processor to cause the images to be simultaneously replaced with designated images associated with the wild function.

13. A gaming device comprising:

at least one display device;

a game operable upon a wager, the game having a plurality of reels displayable by the at least one display device, each of the reels: (i) defining a plurality of locations for a plurality of symbols; and (ii) displaying a plurality of symbols, each of the symbols having at least one characteristic, a plurality of the characteristics being different from one another, and the symbols being combinable to form a first combination of symbols and a second combination of symbols, the first combination being different from the second combination, the first and second combinations being positioned along a plurality of different pay lines;

a plurality of winning conditions associated with a plurality of the first and the second combinations;

an award associated with each one of the winning conditions;

at least one input device operable by a player; and a processor in control of the at least one display device, the processor programmed to operate with the at least one display device and the at least one input device to:

(a) receive the first input signal from the input device, the input signal corresponding to the wager;

(b) display the reels;

(c) receive a second input signal from the input device, the second input signal corresponding to a selection of at least one of the plurality of different pay lines;

(d) receive a third input signal from the input device, the third input signal corresponding to a selection of at least one, and less than all, of the locations of the reels, the third input resulting in at least one selected location and at least on non-selected location, the third input signal being performed independent of the second input signal;

(e) display a first spin of the reels resulting in a display of the first and second combinations of symbols (f) determine whether a designated event occurs;

(g) in response to an occurrence of the designated event:

(i) assign at least one of the characteristics to at least one of the symbols in the first combination after said symbol is displayed at the at least one selected location, said symbol being positioned on a first one of the pay lines, wherein the assigned characteristic:

(x) is different from the characteristic of said symbol;

(y) includes the characteristic of at least one of the other symbols; and (z) excludes the characteristic of one or more of the symbols in the second combination, said one or more symbols being positioned along a second one of the pay lines; and (ii) visually distinguish at least one of the locations;

(h) display a second spin of the reels resulting in a display of the first and second combinations of symbols;

(i) for the second spin of the reels, determine whether the at least one visually distinguished location is: (1) the at least one selected location; or (2) the at least one non-selected location;

(j) if the at least one visually distinguished location is the at least one non-selected location, determine if any of the winning conditions are present without taking into account the wild function;

(k) if the at least one visually distinguished location is the at least one selected location:

(x) cause any of the symbols displayed at the at least one visually distinguished location to have the wild function; and (y) determine if any of the winning conditions are present, taking into account any wild function of any of the symbols displayed at the at least one visually distinguished location; and (l) provide the player with any of the awards associated with any of the winning conditions that are present.

14. The gaming device of claim 13, wherein each one of the pay lines includes a pay line selected from the group consisting of a horizontal pay line, a row pay line, a column pay line and a diagonal pay line.

15. The gaming device of claim 13, wherein the gaming device has a data storage device which stores at least one instruction, the instruction being executable by the processor to communicate with a server over a network, the server storing data associated with the game.

16. The gaming device of claim 13, which includes at least one instruction executable by the processor to, after the designated event occurs, assign a plurality of the characteristics to a plurality of selected symbols in the first combination or second combination, wherein each one of the assigned characteristics:

(i) is different from the characteristic of the selected symbol to which said characteristic is being assigned, (ii) includes the characteristic of at least one symbol other than said selected symbol, (iii) excludes the characteristic of one or more of the symbols in the first combination if said selected symbol is in the second combination, and (iv) excludes the characteristic of one or more of the symbols in the second combination if said selected symbol is in first combination.

17. The gaming device of claim 16, which includes at least one instruction executable by the processor to cause an image associated with each one of assigned characteristics to be displayed simultaneously or one at a time.

18. The gaming device of claim 16, which has a data storage device storing at least one instruction executable by the processor to cause each one of the selected symbols to be visually distinguished from the other symbols.

19. A method for operating a gaming device, the method comprising:

(a) receiving a first input signal from an input device, the first input signal corresponding to a wager;

(b) displaying a plurality of reels wherein each of the reels: (i) defines a plurality of locations for a plurality of symbols; and (ii) displays a plurality of different combinations of the symbols, wherein an award is associated with each one of the different combinations, wherein the displayed symbols are different types, and the symbols are groupable to form the first group of symbols and the second group of symbols, the first group being different from the second group;

(c) receiving a second input signal from the input device, the second input signal corresponding to a selection of at least one of a plurality of different pay lines;

(d) receiving a third input signal from the input device, the third input signal corresponding to a selection of at least one, and less than all, of the locations of the reels, the third input resulting in at least one selected location and at least one non-selected location, the third input signal being performed independent of the second input signal;

(e) displaying a first spin of a plurality of the reels, the first spin resulting in a display of the first group and the second group of symbols at a plurality of the locations;

(f) displaying the first and second groups of symbols after the reels stop spinning, wherein:

(i) the first and second groups of symbols are positioned along a plurality of different pay lines; and (ii) the selection occurs separate from a selection, if any, of any of the pay lines;

(g) after a designated event occurs:

(i) applying a wild function to at least a first one of the symbols in the first group after said symbol is displayed at the at least one selected location, the first symbol being positioned on a first one of the pay lines, wherein the wild function is:

(x) operable on at least one of the other symbols of a different type than the first symbol, the other symbol being within the first or second group, and (y) inoperable on one or more of the symbols in the second group, said one or more symbols being positioned along a second one of the pay lines; and (ii) visually distinguishing at least one of the locations;

(h) displaying a second spin of the plurality of reels resulting in a display of a the first group and the second group of symbols at a plurality of the locations;

(i) for the second spin of the reels, determine whether the at least one visually distinguished location is: (1) the at least one selected location; or (2) the at least one non-selected location;

(j) determining if any of the winning conditions are present without taking into account the wild function if the at least one visually distinguished location is the at least one non-selected location;

(k) if the at least one visually distinguished location is the at least one selected location:

(x) causing any of the symbols displayed at the at least one visually distinguished location to have the wild function; and (y) determining if any of the winning conditions are present, taking into account any wild function of any of the symbols displayed at the at least one visually distinguished location; and (l) providing the player with the awards associated with any of the winning conditions that are present.

20. The method of claim 19, wherein each one of the pay lines includes a pay line selected from the group consisting of a horizontal pay line, a row pay line, a column pay line and a diagonal pay line.

21. The method of claim 19, which includes storing at least one instruction which is executable by the processor to communicate with a server over a network, the server storing data associated with the symbols.

22. The method of claim 19, which includes: (a) causing a plurality of the symbols to have the wild function; and (b) causing each of said symbols to be displayed simultaneously or one at a time.

23. A method for operating a gaming device, the method comprising:

(a) receiving a first input signal from an input device, the first input signal corresponding to a wager;

(b) displaying a plurality of reels wherein each of the reels: (i) defines a plurality of locations for a plurality of symbols; and (ii) displays a plurality of the symbols, the symbols being combinable to form a first combination of symbols and a second combination of symbols, the first combination being different from the second combination, wherein the plurality of different combinations are each associated with a plurality of winning conditions, wherein each one of the winning conditions are associated with an award;

(c) receiving a second input signal from the input device, the second input signal corresponding to a selection of at least one of a plurality of different pay lines;

(d) receiving a third input signal from the input device, the third input signal corresponding to a selection of at least one, and less than all, of the locations of the reels, the third input resulting in at least one selected location and at least one non-selected location, the third input signal selection occurring separate from the second input signal selection;

(e) displaying a first spin of a plurality of the reels resulting in a display of the first and second combinations of symbols, wherein:

(i) each of a plurality of symbols of the reels has at least one characteristic;

(ii) a plurality of the characteristics are different from one another; and (iii) the first and second combinations of symbols are positioned along a plurality of different pay lines; and (f) after a designated event occurs:

(i) assigning at least one of the characteristics to at least one of the symbols in the first combination after said symbol is displayed at the at least one selected location, said symbol being positioned on a first one of the pay lines, wherein the assigned characteristic:

(x) is different from the characteristic of said symbol;

(y) includes the characteristic of at least one of the other symbols; and (z) excludes the characteristic of one or more of the symbols in the second combination, said one or more symbols being positioned along a second one of the pay lines; and (ii) visually distinguishing at least one of the locations;

(g) displaying a second spin of the plurality of reels resulting in a display of the first and second combinations of symbols a plurality of the symbols at a plurality of the locations;

(h) for the second spin of the reels, determine whether the at least one visually distinguished location is: (1) the at least one selected location; or (2) the at least one non-selected location;

(i) determining if any of the winning conditions are present without taking into account the wild function if the at least one visually distinguished location is the at least one non-selected location;

(j) if the at least one visually distinguished location is the at least one selected location:

(x) causing any of the symbols displayed at the at least one visually distinguished location to have the wild function; and (y) determining if any of the winning conditions are present, taking into account any wild function of any of the symbols displayed at the at least one visually distinguished location; and (k) providing the player with the award associated with any of the winning conditions that are present.

24. The method of claim 23, wherein each one of the pay lines includes a pay line selected from the group consisting of a horizontal pay line, a row pay line, a column pay line and a diagonal pay line.

25. The method of claim 23, which includes storing at least one instruction, the instruction being executable by the processor to communicate with a server over a network, the server storing data associated with the symbols.

26. The method of claim 23, which includes, after the designated event occurs, assigning a plurality of the characteristics to a plurality of selected symbols in the first combination or second combination, wherein each one of the assigned characteristics:

(i) is different from the characteristic of the selected symbol to which said characteristic is being assigned, (ii) includes the characteristic of at least one symbol other than said selected symbol, (iii) excludes the characteristic of one or more of the symbols in the first combination if said selected symbol is in the second combination, and (iv) excludes the characteristic of one or more of the symbols in the second combination if said selected symbol is in first combination.

27. The method of claim 26, which includes causing an image associated with each one of assigned characteristics to be displayed simultaneously or one at a time.

28. A gaming device comprising:

at least one display device;

a game operable upon a wager, the game including a plurality of reels displayable by the at least one display device, each one of the reels defining a plurality of locations for a plurality of symbols, the symbols being combinable to form a plurality of combinations of the symbols, each one of the combinations having a non-linear configuration;

at least one winning condition associated with at least one of the combinations;

an award associated with the winning condition;

at least one input device operable by a player; and a processor in control of the at least one display device, the processor programmed to operate with the at least one display device and the at least one input device to:

(a) receive a first input signal from the input device, the first input signal corresponding to the wager;

(b) display the reels;

(c) receive a second input signal from the input device, the second input signal corresponding to a selection of at least one of a plurality of different pay lines;

(d) receive a third input signal from the input device, the third input signal corresponding to a selection of at least one, and less than all, of the locations of the reels, the third input resulting in at least one selected location and at least one non-selected location, the third input signal being performed independent of the second input signal;

(e) display a first spin of the reels resulting in a display of the combinations of symbols at a plurality of the locations;

(f) determine whether a designated event occurs; and (g) in response to an occurrence of the designated event:
(i) cause the display device to visually distinguish said at least one selected location;
(ii) cause any of the symbols displayed at said at least one selected location to have a wild function, the wild function being:
(x) operable on a first one or more of the symbols in the displayed combination,
(y) inoperable on one or more of the other symbols, and
(z) operable to increase a likelihood of meeting the winning condition; and
(h) display a second spin of the reels resulting in a display of a plurality of the symbols at a plurality of the locations;
(i) for the second spin of the reels, determine whether the at least one visually distinguished location is: (1) the at least one selected location; or (2) the at least one non-selected location:
(j) if the at least one visually distinguished location is the at least one non-selected location, determine if any of the winning conditions are present without taking into account the wild function;
(k) if the at least one visually distinguished location is the at least one selected location:
(x) cause any of the symbols displayed at the at least one visually distinguished location to have the wild function; and
(y) determine if any of the winning conditions are present, taking into account any wild function of any of the symbols displayed at the at least one visually distinguished location; and
(l) provide the player with the awards associated with any of the winning conditions that are present.

29. The gaming device of claim 28, wherein the non-linear configuration includes a configuration selected from the group consisting of a non-linear pay line, a scatter pay combination and a positional scatter arrangement.

30. The gaming device of claim 28, which includes at least one instruction executable by the processor to: (a) cause a plurality of first symbols to have the wild function; and (b) cause each of the first symbols to be displayed one at a time.

31. The gaming device of claim 28, which includes at least one instruction executable by the processor to simultaneously cause each of the first symbols displayed at each one of the at least one selected location to have the wild function.

32. A gaming device comprising:
at least one display device;
a game operable upon a wager, the game having a plurality of reels displayable by the at least one display device, each of the reels defining a plurality of locations for a plurality of symbols, each of the symbols having at least one characteristic, a plurality of the characteristics being different from one another, and the symbols being combinable to form a plurality of combinations of symbols, each one of the combinations having a non-linear configuration;
a plurality of winning conditions associated with a plurality of the combinations;
an award associated with each one of the winning conditions;
at least one input device operable by a player; and
a processor in control of the at least one display device, the processor programmed to operate with the at least one display device and the at least one input device to:
(a) receive a first input signal from the input device, the first input signal corresponding to the wager;
(b) display the reels;
(c) receive a second input signal from the input device, the second input signal corresponding to a selection of at least one of a plurality of different pay lines;
(d) receive a third input signal from the input device, the third input signal corresponding to a selection of at least one, and less than all, of the locations of the reels, the third input resulting in at least one selected location and at least one non-selected location, the third input signal being performed independent of the second input signal;
(e) display a first spin of the reels resulting in a display of the combinations of symbols at a plurality of the locations;
(f) determine whether a designated event occurs;
(g) in response to an occurrence of the designated event:
(i) assign at least one of the characteristics to at least a first one of the symbols in the displayed combination after said symbol is displayed at the at least one selected location, wherein the assigned characteristic:
(x) is different from the characteristic of the first symbol,
(y) is identical to the characteristic of at least a second one of the symbols, and
(z) excludes the characteristic of at least a third one of the symbols; and
(ii) visually distinguish at least one of the locations;
(h) display a second spin of the reels resulting in a display of the combinations of symbols at a plurality of the locations;
(i) for the second spin of the reels, determine whether the at least one visually distinguished location is: (1) the at least one selected location; or (2) the at least one non-selected location;
(j) if the at least one visually distinguished location is the at least one non-selected location, determine if any of the winning conditions are present without taking into account the assigned characteristic;
(k) if the at least one visually distinguished location is the at least one selected location:
(x) cause any of the symbols displayed at the at least one visually distinguished location to have the assigned characteristic; and
(y) determine if any of the winning conditions are present, taking into account any assigned characteristic of any of the symbols displayed at the at least one visually distinguished location; and
(l) provide the player with the awards associated with any of the winning conditions that are present.

33. The gaming device of claim 32, wherein the non-linear configuration includes a configuration selected from the group consisting of a non-linear pay line, a scatter pay combination and a positional scatter arrangement.

34. The gaming device of claim 32, which includes at least on instruction executable by the processor to: (a) cause the display device to visually distinguish a plurality of the locations on the reels from a plurality of the other locations on the reels; and (b) cause each one of the symbols displayed at each one of the visually distinguished locations to have the assigned characteristic.

35. The gaming device of claim 32, wherein the gaming device has a data storage device which stores at least one instruction, the instruction being executable by the processor to communicate with a server over a network, the server storing data associated with the game.

36. A gaming device comprising:

a plurality of reels, each one of the reels providing a plurality of locations for a plurality of symbols, the symbols being arrangeable into a plurality of combinations including at least one winning combination and at least one non-winning combination;

a winning outcome associated with the winning combination;

a non-winning outcome associated with the non-winning combination;

at least one input device operable by a player; and a processor in control of the at least one display device, the processor programmed to operate with the at least one display device and the at least one input device to:

(a) receive a first input signal from the input device, the first input signal corresponding to a wager;

(b) display the reels;

(c) receive a second input signal from the input device, the second input signal corresponding to a selection of at least one of a plurality of different pay lines;

(d) receive third input signal from the input device, the third input signal corresponding to a selection of at least one, and less than all, of the locations of the reels, the third input resulting in at least one selected location and at least one non-selected location, the third input signal being performed independent of the second input signal;

(e) display a first spin of the reels resulting in a display of a plurality of the symbols at a plurality of the locations;

(f) determine whether a triggering event occurs;

(g) in response to an occurrence of the triggering event, visually distinguish at least one of the locations;

(h) determine whether the at least one visually distinguished location is: (1) the at least one selected location; or (2) the at least one non-selected location;

(i) if the at least one visually distinguished location is the at least one non-selected location, determine if any of the winning conditions are present without taking into account a wild function;

(j) if the at least one visually distinguished location is the at least one selected location:

(i) treat said visually distinguished location as wild, (ii) determine whether the winning combination occurs based on the wild treatment of said location, (iii) provide the winning outcome if the winning combination occurs, and (iv) provide the non-winning outcome if the winning combination does not occur.

37. The gaming device of claim 36, wherein: (a) the first type includes a first symbol characteristic; and (b) the second type includes a second symbol characteristic which is different from the first symbol characteristic.

38. The gaming device of claim 37, wherein the first symbol characteristic includes a characteristic selected from the group consisting of meaning, information, concept, shape, size, form and color.

39. The gaming device of claim 38, wherein the second symbol characteristic includes a characteristic selected from the group consisting of meaning, information, concept, shape, size, form and color.

40. A gaming device comprising:

a plurality of reels, each one of the reels providing a plurality of locations for a plurality of symbols, the symbols being arrangeable into a plurality of combinations including at least one winning combination and at least one non-winning combination;

a winning outcome associated with the winning combination;

a non-winning outcome associated with the non-winning combination;

an award associated with the winning outcome;

at least one input device operable by a player;

a triggering event that occurs in response to a designated one or more of the symbols being displayed during the game; and a processor programmed to:

(a) receive a first input signal from the input device, the first input signal corresponding to a wager;

(b) display the reels;

(c) receive a second input signal from the input device, the second input signal corresponding to a selection of at least one of a plurality of different pay lines;

(d) receive a third input signal from the input device, the third input signal corresponding to a selection of at least one, and less than all, of the locations of the reels, the third input resulting in at least one selected location and at least one non-selected location, the third input signal being performed independent of the second input signal;

(e) display a first spin of the reels resulting in a display of a plurality of the symbols at a plurality of the locations;

(f) determining whether a triggering event occurs;

(g) in response to an occurrence of the triggering event, visually distinguish at least one of the locations;

(h) determine whether the at least one visually distinguished location is: (1) the at least one selected location; or (2) the at least one non-selected location:

(i) if the at least one visually distinguished location is the at least one non-selected location, determine if any of the winning conditions are present without taking into account a wild function;

(j) if the at least one visually distinguished location is the at least one selected location:

(i) treat said location as wild, (ii) determine whether the winning combination occurs based on the wild treatment of said location, (iii) provide the winning outcome if the winning combination occurs, and (iv) provide the non-winning outcome if the winning combination does not occur.

41. The gaming device of claim 40, wherein: (a) the first type includes a first symbol characteristic; and (b) the second type includes a second symbol characteristic which is different from the first symbol characteristic.

42. The gaming device of claim 41, wherein the first symbol characteristic includes a characteristic selected from the group consisting of meaning, information, concept, shape, size, form and color.

43. The gaming device of claim 42, wherein the second symbol characteristic includes a characteristic selected from the group consisting of meaning, information, concept, shape, size, form and color.

* * * * *